US007174120B2

(12) United States Patent
Koyama et al.

(10) Patent No.: US 7,174,120 B2
(45) Date of Patent: Feb. 6, 2007

(54) DEVELOPER SUPPLY DEVICE CONTAINING A STOPPING MEMBER WHICH MOVES INTO A TONER SUPPLY PORT AND RESTRICTS ROTATION OF THE DEVICE AND IMAGE FORMING APPARATUS INCLUDING THE SAME

(75) Inventors: Kazuya Koyama, Ikoma (JP); Masanobu Deguchi, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 127 days.

(21) Appl. No.: 11/005,195

(22) Filed: Dec. 7, 2004

(65) Prior Publication Data

US 2005/0123323 A1 Jun. 9, 2005

(30) Foreign Application Priority Data

Dec. 9, 2003 (JP) ..... 2003-410903

(51) Int. Cl.
*G03G 15/08* (2006.01)

(52) U.S. Cl. ..... 399/258; 399/260

(58) Field of Classification Search ..... None
See application file for complete search history.

(56) References Cited

U.S. PATENT DOCUMENTS 5,455,662 A 10/1995 Ichikawa et al.
5,722,020 A * 2/1998 Matsuoka et al. ..... 399/262
6,766,133 B1 * 7/2004 Ban et al. ..... 399/258
2005/0058471 A1 * 3/2005 Nagahama et al. ..... 399/262

FOREIGN PATENT DOCUMENTS

JP 6-348127 A 12/1994
JP 7-20705 A 1/1995
JP 8-339115 A 12/1996

* cited by examiner

*Primary Examiner*—Quana Grainger
(74) *Attorney, Agent, or Firm*—Nixon & Vanderhye P.C.

(57) ABSTRACT

A toner supply device includes a stopping member which moves into the toner supply port by interlocking with opening and closing of a shutter plate for opening and closing the toner supply port, and a scraper for scraping toner supplied from a toner container is pressed by the stopping member, thereby sliding in contact along the recessed portion of the toner container, thus restricting the rotation of the toner container. This restricts the rotation of the developer supply device due to user's operating error, preventing developer from spilling out from the developer supply port.

24 Claims, 18 Drawing Sheets to state shown in FIG.17(b)

INSIDE OF PRINTER
OUTSIDE OF PRINTER
HOPPER AREA
TONER SUPPLY DEVICE AREA 8
102
103
101
104
58
58a
58j
58f
58d
58b
58g

PRIOR ART

DEVELOPER SUPPLY DEVICE CONTAINING A STOPPING MEMBER WHICH MOVES INTO A TONER SUPPLY PORT AND RESTRICTS ROTATION OF THE DEVICE AND IMAGE FORMING APPARATUS INCLUDING THE SAME

This Nonprovisional application claims priority under 35 U.S.C. § 119(a) on Patent Application No. 2003/410903 filed in Japan on Dec. 9, 2003, the entire contents of which are hereby incorporated by reference.

FIELD OF THE INVENTION

The present invention relates to a developer supply device, for use in electrophotographic image formation, for supplying developer to a developing device, and an image forming apparatus including the developer supply device.

BACKGROUND OF THE INVENTION

To a developing device included in an image forming apparatus utilizing electrophotography, such as a copier, a facsimile machine, and a printer, a toner is supplied using a toner container which is detachably provided to the image forming apparatus. Conventionally, for realization of a preferred supply of toner from the toner container to the developing device, various kinds of toner containers have been suggested.

For example, in patent document 1 (Japanese Laid-Open Patent Application No. 20705/1995 (Tokukaihei 7-20705; published on Jan. 24, 1995)), as shown in FIG. 19, a cylindrical toner container 150 is provided with a spiral guide flute 152 for supplying a toner from an opening 151 to the developing device in a preferred manner, the opening 151 being provided at one end surface of the toner supply container 150, the guide flute 152 being provided around the surface of the toner supply container 150. The guide flute 152 is provided in a spiral manner toward the opening 151 at one end surface of the toner supply container 150. Therefore, by rotation of the toner supply container 150 described in the patent document 1 on its cylinder axis as a rotation axis, toner is transported to the opening 151 along the guide flute 152 in the toner supply container 150, and then the toner is supplied to the developing device.

Patent document 2 (Japanese Laid-Open Patent Application No. 339115/1996 (Tokukaihei 8-339115; published on Dec. 24, 1996)) discloses a developer supply container arranged such that an outlet for releasing developer, provided in a center portion of a developer container body, is hermetically sealed with a seal or the like until the developer container is loaded inside the image forming apparatus. Patent document 3 (Japanese Laid-Open Patent Application No. 348127/1994 (Tokukaihei 6-348127; published on Dec. 22, 1994)) discloses a toner cartridge arranged such that an opening of a cylindrical container is sealed with a seal member, such as seal film, during storage or transportation, which making up a sealed container.

However, in the conventional arts, in detaching/attaching a toner supply device from/to the image forming apparatus, toner spills out from a toner supply port. This causes the problem that the user and the image forming apparatus become dirty with the spilled toner. In order to solve such a problem, arrangements including the following arrangements are widely used: an arrangement in which an openable and closable shutter is provided with respect to the toner supply port for supplying toner from the toner supply device to a toner hopper and an arrangement in which a toner outlet provided to a toner container is adhesively sealed with a film seal member. In a similar manner, the inventors of the present application also contemplated adding a shutter and a seal member and others to the toner supply device. However, it turned out that the use of a conventional, widespread arrangement alone is not an adequate measure to solve the above problem.

More specifically, for example, even if instructions give precautions, for the user who deals with a toner supply device for exchange, not to twist the toner container, the user moves the toner container since the toner container is movable. As a result of this, the seal member having adhesively sealed the toner outlet is unstuck, whereby toner may spill out from the outlet of the toner container in the toner supply device. If, in such a state, the user ignores the precautions and opens a shutter for opening and closing the toner supply port which is provided to the toner supply device, or if the shutter automatically opens during installation of the toner supply device to a printer, toner spills out from the toner supply port of the toner supply device. This causes the problem that the users and the toner supply device become dirty with the spilled toner.

SUMMARY OF THE INVENTION

The present invention has been made to solve the conventional problem, and an object of the present invention is to restrict the rotation of the toner container due to user's operating error during handling of the toner container. In addition, the present invention offers a developer supply device which can achieve the above object and prevent toner from spilling out of a toner supply port and an image forming apparatus including the developer supply device.

In order to achieve the above object, a developer supply device of the present invention is arranged so as to be a developer supply device which supplies developer to an outside of the developer supply device by rotating a cylindrical developer container containing the developer on an axis line of the developer container as a rotation axis, wherein:

the developer container has an outlet in a recessed portion provided on an outer circumferential surface of the developer container, the developer supply device includes:

a support member, by surrounding at least a recessed portion forming region formed around the outer circumferential surface along a direction of rotation of the developer container so as to include the recessed portion, rotatably holding the developer container, and having a developer supply port for supplying, to the outside of the developer supply device, the developer ejected from the outlet into the recessed portion; and a scraping member, provided in the developer supply port so as to slide along the recessed portion forming region during rotation of the developer container, scraping the developer in the recessed portion by sliding along the recessed portion in the recessed portion forming region;

the support member being provided with a shutter including a movable plate part for opening and closing the developer supply port, the shutter having a stopping member moving into the developer supply port by interlocking with movement of the plate part closing the developer supply port, and thereby pushing the scraping member into the recessed portion and restricting the rotation of the developer container. The shutter having a stopping member thus being a rotation restricting member.

According to the above arrangement, the stopping member moves so as to project into the developer supply port on the developer container side by interlocking with closing of the shutter, so that it is possible to restrict the rotation of the developer container when the developer supply port is closed by the shutter. Therefore, it is possible to prevent developer from spilling out from the outlet due to the rotation of the developer supply device by user's operating error. Accordingly, it is possible to prevent the problem that the users and the developer supply device become dirty with the developer spilled out of the developer supply port of the developer supply device when the shutter is opened.

BRIEF DESCRIPTION OF THE DRAWINGS

FIG. 1(*b*) is an exploded perspective view of the toner supply device shown in FIG. 1(*a*).

FIG. 8(*b*) is a cross sectional view showing a state where the toner ejecting sheet is away from the first recessed portion when the toner container in the state shown in FIG. 8(*a*) further rotates.

FIG. 9(*b*) is a cross sectional view showing the structure of the toner supply port and its peripheral area where the rotation of the toner supply device shown in FIG. 1(*a*) in one direction is restricted.

FIG. 9(*c*) is a cross sectional view showing the structure of the toner supply port and its peripheral area where the rotation of the toner supply device shown in FIG. 1(*a*) in the reverse direction is restricted.

FIG. 10(*b*) is a perspective view showing the toner supply port as viewed from the toner container side in the toner supply device shown in FIG. 1(*a*).

FIG. 11(*b*) is a perspective view showing the state of the shutter when detachment of the toner supply device shown in FIG. 1(*a*) from the printer is completed.

FIG. 13(*b*) is a cross sectional view showing a state where the toner outlet in the state shown in FIG. 13(*a*) is unsealed.

FIG. 14(*b*) is a cross sectional view showing a state where the toner ejecting sheet is placed in the first recessed portion when the toner container in the state shown in FIG. 14(*a*) rotates.

FIG. 17(*b*) is a cross sectional view showing a state where the shutter plate is closed in the shutter shown in FIG. 1(*a*).

FIG. 17(*c*) is a cross sectional view showing the shutter plate in the state shown in FIG. 17(*b*) being opened.

FIG. 17(*d*) is a cross sectional view showing a state where opening of the shutter plate in the state shown in FIG. 17(*c*) is completed.

FIG. 17(*e*) is a cross sectional view showing the shutter plate in the state shown in FIG. 17(*d*) being closed.

FIG. 18(*b*) is a cross sectional view showing a state where the installation proceeds from the state shown in FIG. 18(*a*), and a stopper releases stop of the shutter plate.

FIG. 18(*c*) is a cross sectional view showing a state where the installation proceeds from the state shown in FIG. 18(*b*), and opening of the shutter plate is started.

FIG. 18(*d*) is a cross sectional view showing a state where the installation proceeds from the state shown in FIG. 18(*c*), and the shutter plate is completely opened.

FIG. 18(*e*) is a cross sectional view showing a state at the start of detachment of the toner supply device from the printer.

FIG. 18(*f*) is a cross sectional view showing a state where the detachment proceeds from the state shown in FIG. 18(*e*), and closing of the shutter plate is started.

FIG. 18(*g*) is a cross sectional view showing a state where the detachment proceeds from the state shown in FIG. 18(*f*), and the shutter plate is completely closed.

FIG. 18(*h*) is a cross sectional view showing a state where, after the state shown in FIG. 18(*f*), the toner supply device is completely detached from the printer.

DESCRIPTION OF THE EMBODIMENTS

Referring to FIG. 1 through FIG. 18, the following will describe one embodiment of the present invention.

Figure 2:
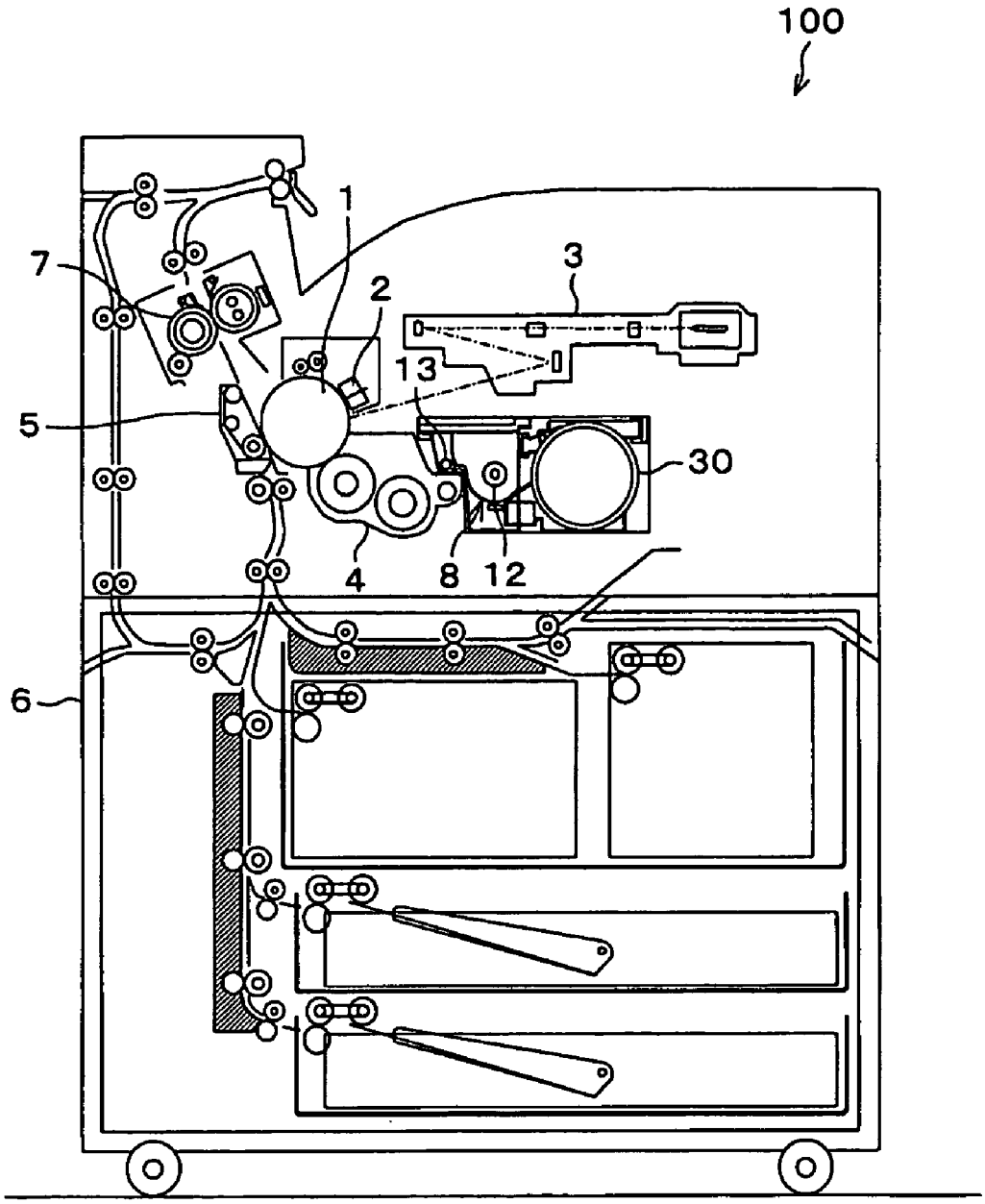
FIG. 2 is a plan view of an image forming apparatus including the toner supply device according to one embodiment of the present invention.

FIG. 2 is a plan view of a printer (image forming apparatus) 100 including a toner supply device (developer supply device) 30 according to the present embodiment. The toner supply device 30 is detachably provided in the electrophotographic printer 100 shown in FIG. 2. Through a hopper 8, the toner supply device 30 supplies toner (developer) to a developing device 4. The toner may be a two-component toner containing a carrier, or one-component toner containing no carrier. Further, the toner used in the toner supply device 30 may have a particle size as small as or less than 7 μm, so that the particles can easily aggregate themselves.

In addition to the toner supply device 30, the toner hopper 8, and the developing device 4, the printer 100 further includes a photosensitive drum 1, a charger 2, a laser exposing device 3, a transfer device 5, a feeder 6, and a fixing section 7, as illustrated in FIG. 2. In order to form image, the printer 100 as structured above electrifies the photosensitive drum 1 (electrostatic latent image carrier) with the charger 2, and forms an electrostatic latent image on the surface of the photosensitive drum 1 with the laser exposing device 3. Using the developing device 4, the electrostatic latent image formed on the photosensitive drum 1 is then developed into a toner image with the toner supplied from the toner supply device 30 through the hopper 8. With the transfer device 5, the toner image formed on the photosensitive drum 1 is transferred onto a recording sheet transported through the feeder 6. The transferred toner image on the recording sheet is fixed by the fixing section 7 before it is ejected out of the printer 100.

Figure 3:
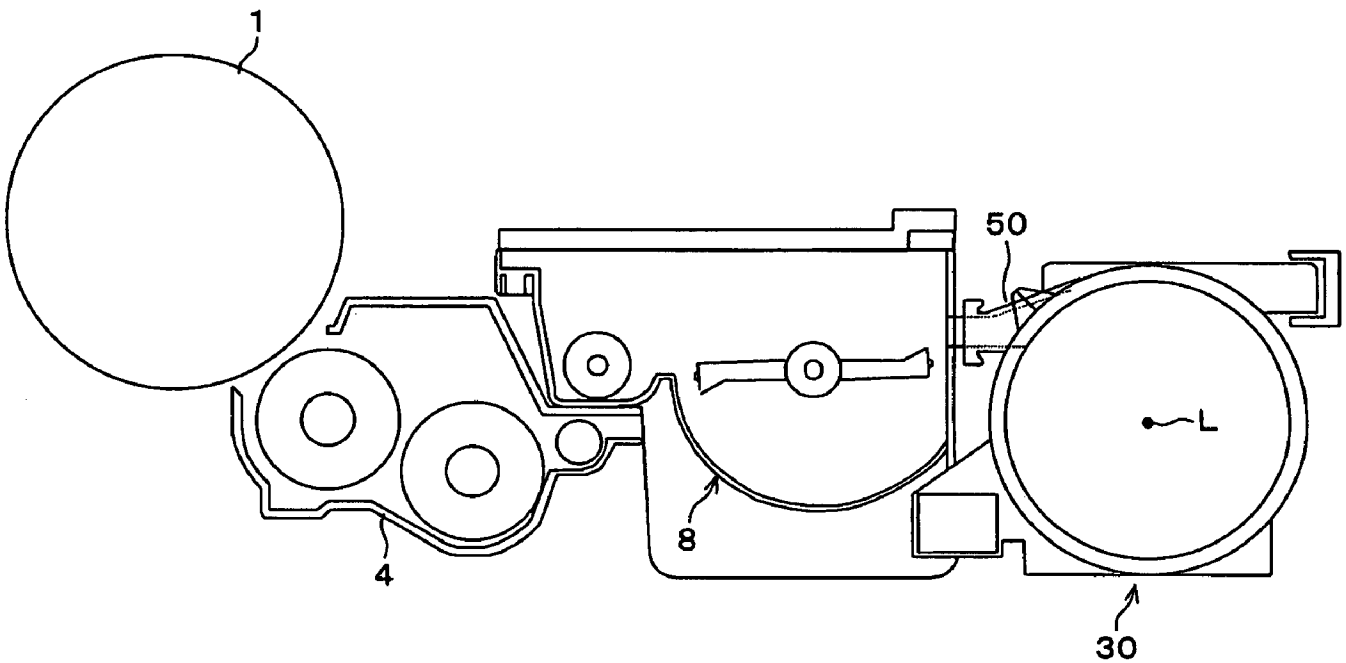
FIG. 3 is a plan view illustrating the toner supply device and a developing device.

FIG. 3 is a plan view illustrating the toner supply device 30 and the developing device 4 of the present embodiment as installed in the printer 100. The toner supply device 30, the toner hopper 8, and the developing device 4 are disposed in this order in a transport direction of toner in the printer 100, as shown in FIG. 3. With this construction, the toner ejected from the toner supply device 30 is stirred in the hopper 8 en route to the developing device 4. The developing device 4 supplies the toner to the photosensitive drum 1.

Figure 1:
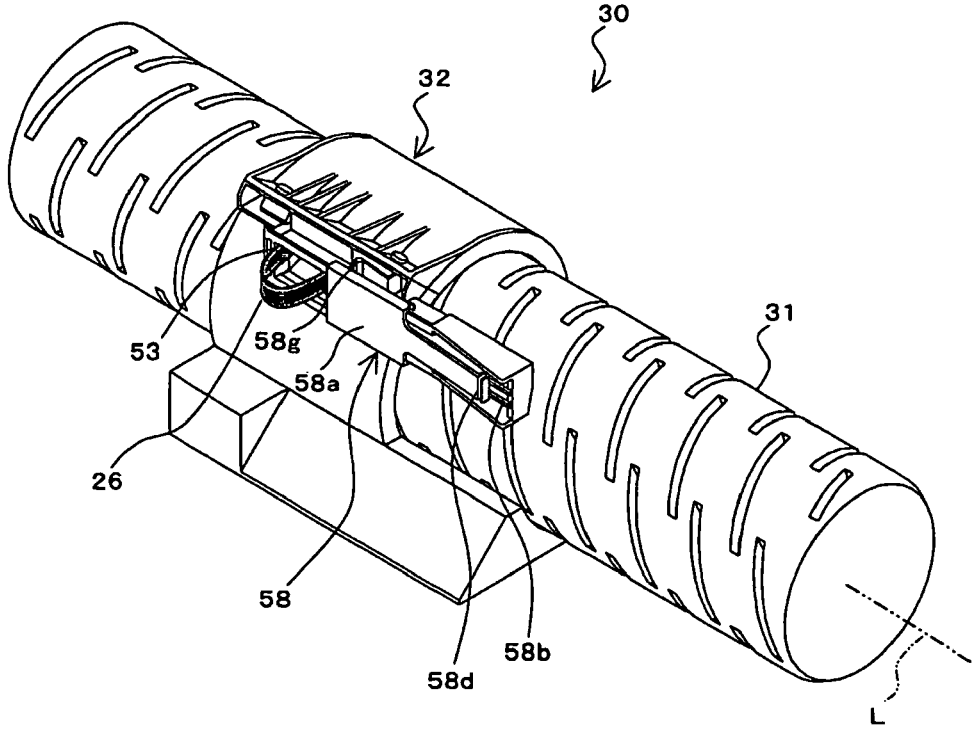
FIG. 1(*a*) is a perspective view of a toner supply device in one embodiment of the present invention.
Figure 1:
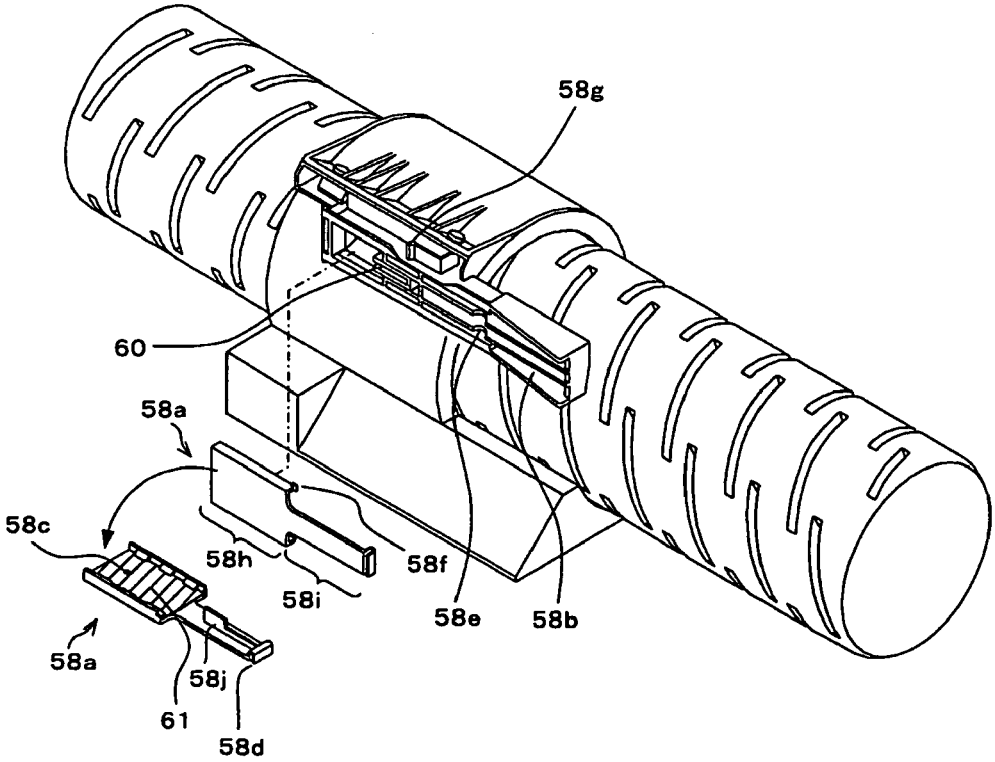

FIG. 1(*a*) and FIG. 1(*b*) are perspective views of the toner supply device 30. As illustrated in FIG. 1(*a*) and FIG. 1(*b*), the toner supply device 30 includes a toner container (developer container) 31, and a support member 32 for rotatably supporting the toner container 31, enabling the toner container 31 to rotate on a cylinder axis (axis line) L, as a rotation axis. The support member 32 includes a shutter 58 for opening or closing an opening 53.

As illustrated in FIG. 1(*a*), the shutter 58 includes two main parts: a shutter plate (plate part) 58*a* and a shutter plate guide (plate guide) 58*b*. The opening 53 is provided in the shutter plate guide 58*b* of the shutter 58. Through the opening 53, toner is ejected into the toner hopper 8 side.

As illustrated in FIG. 1(*b*), the shutter plate 58*a* includes an opening covering portion 58*h* and a slider portion 58*i*. The opening covering portion 58*h* is provided to cover the opening 53 of a substantially rectangular shape. The slider portion 58*i*, smaller in width than a portion covering the opening 53, slides along the shutter plate guide 58*b*. Further, the opening covering portion 58*h* on the edge closer to the slider portion 58*i* has a locking pawl 58*f*.

Further, the shutter plate 58*a* on the end of the slider portion 58*i* (i.e., the end of the slider portion 58*i* in a direction of movement of the shutter plate 58*a*) has an elastic end portion 58*d* formed of an elastic member. The shutter plate 58*a* at the elastic end portion 58*d* has a U-shape transverse section. Further, the shutter plate 58*a* on the surface ("back surface" hereinafter) of the opening covering portion 58*h* facing the shutter plate guide 58*b* has a projection 58*c*. The back surface of the opening covering portion 58*h* also has a felt (sliding member) 61 bonded thereto, except for portions provided with the projection 58*c*. The shutter plate 58*a* on the back surface of the slider portion 58*i* has a plate projection 58*j*. The plate projection 58*j* stands substantially perpendicular to the back surface, and extends in a direction of movement (open/close) of the shutter plate 58*a*.

The shutter guide 58*b* has a stopper 58*g*, and a notch 58*e* (recessed portion) formed on the surface of the shutter guide 58*b* facing the shutter plate 58*a*. The notch 58*e* is so formed that it fits the elastic end portion 58*d* when the shutter plate 58*a* is closed. The stopper 58*g* is formed of an elastic member and serves to stop the shutter plate 58*a* and thereby prevents the shutter plate 58*a* from moving in an opening direction when the opening 53 is closed by the shutter plate 58*a*. That is, the locking pawl 58*f* provided on the shutter plate 58*a* stops on an end of the stopper 58*g* when the shutter plate 58*a* is in the closed position, preventing the shutter plate 58*a* from being opened accidentally.

The shutter plate guide 58*b* of the shutter 58 has a stopping member 60. The stopping member 60 moves into the opening 53 by interlocking with the shutter plate 58*a* being closed, and thereby pushes a scraper 20 (scraping member, see FIG. 6) into a recessed portion and restricts the rotation of the toner container 31. The shutter, shutter plate guide, scraper and stopping member thereby forming a rotation restricting member. The scraper 20 is provided to scrape the toner supplied from the toner container 31. The stopping member 60 is held on the shutter plate guide 58*b* such that it can move parallel to the open/close direction of the shutter plate 58*a*, i.e., from a retract position in the shutter plate guide 58*b* into the opening 53. As to the scraper 20 and the movement of the stopping member 60, detailed description will be made later.

Figure 4:
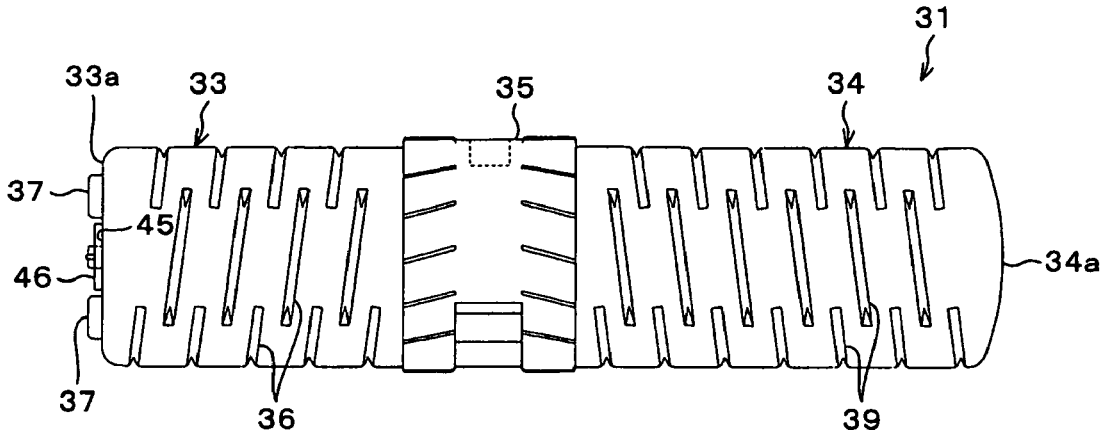
FIG. 4 is a side view of the toner supply device.
Figure 5:
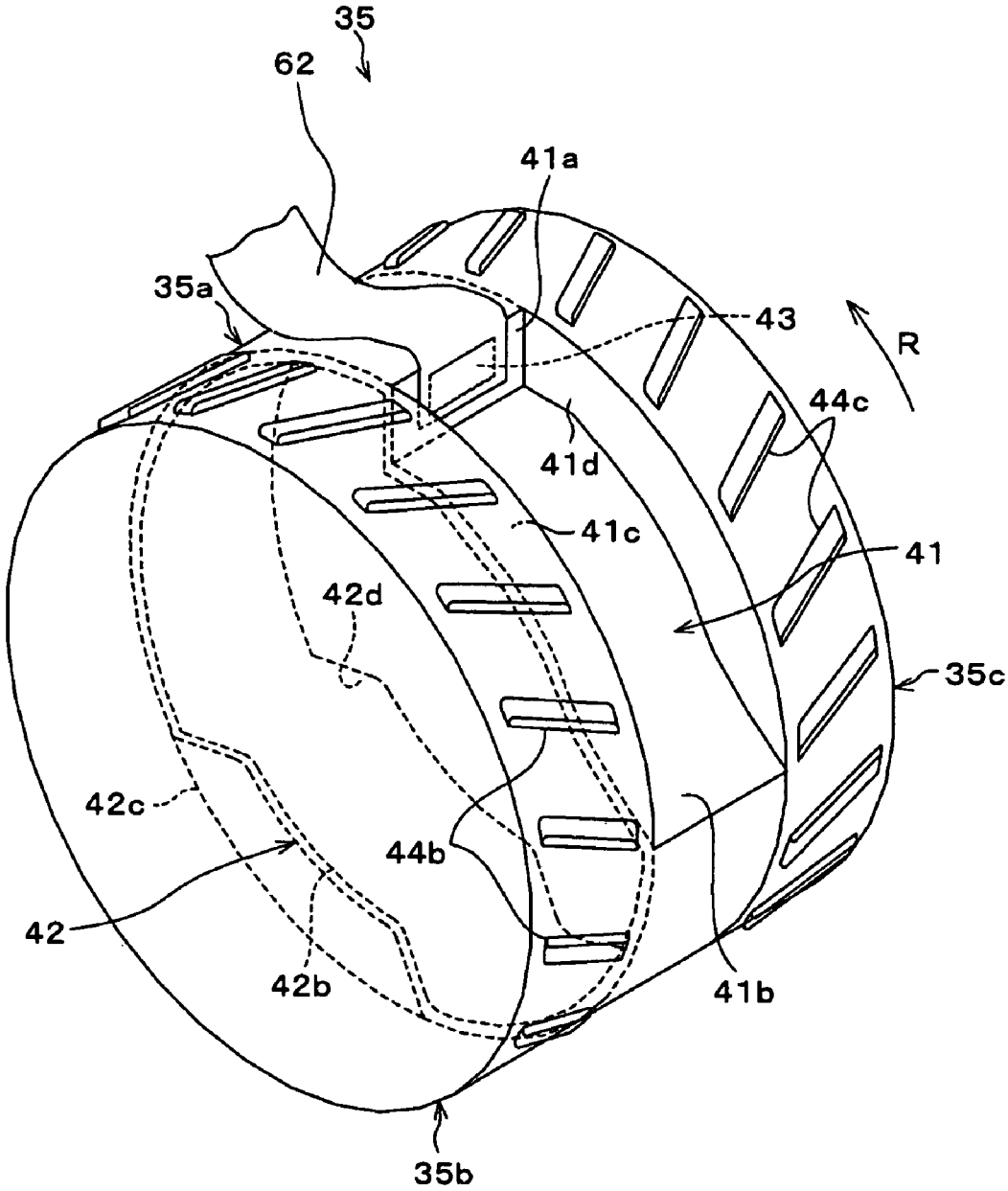
FIG. 5 is a perspective view showing a third container portion of the toner supply device shown in FIG. 1(*a*).

FIG. 4 is a side view of the toner container 31. As illustrated in FIG. 4, the toner container 31 is cylindrical in shape, and as it rotates on its cylinder axis, ejects the toner contained therein into a first recessed portion 41 (FIG. 5) through a toner outlet 43 (FIG. 5, described later). As shown in FIG. 4, the toner container 31 includes a first container portion 33, a second container portion 34, and a third container portion 35, all cylindrical in shape and provided along the cylinder axis direction. The first container portion 33, the second container portion 34, and the third container portion 35 are produced in one piece by blow molding, using a synthetic resin such as polyethylene, for example. The third container portion 35 is formed between the first container portion 33 and the second container portion 34. The first container portion 33 and the second container portion 34 have a bottom portion 33*a* and a bottom portion 34*a*, respectively, sealing the toner container 31 at the both ends.

The first container portion 33 of the toner container 31 is joined to a main-body joint 80 (see FIG. 12, described later) provided in the printer 100. Accordingly, the first container portion 33 on its bottom portion 33*a* has two raised portions 37 that project out of the bottom portion 33*a* to be joined to the main-body joint 80. The raised portions 37 are provided substantially symmetrical about the center of the bottom portion 33*a*, i.e., about the cylinder axis of the toner container 31. The toner supply device 30 is installed in the printer 100 via the raised portions 37, allowing the driving power from a driving source of the printer 100 to be transmitted and thereby rotating the toner container 31 on its cylinder axis.

As illustrated in FIG. 4, the bottom portion 33*a* further includes a toner supply opening 45 formed through a portion of the bottom portion 33*a*, and a lid 46 detachably provided on the toner supply opening 45. The toner supply opening 45 is provided to supply toner to the toner container 31. Further, the toner supply opening 45 is circular in shape and formed at a central portion of the bottom portion 33*a*, with its center coinciding with the cylinder axis. The lid 46 closes the toner supply opening 45 by completely covering it. Further, the lid 46 is fastened such that the rotation of the toner container 31 on the cylinder axis does not separate the lid 46 from the toner supply opening 45. In supplying toner to the toner container 31 through the toner supply opening 45, the lid 46 is separated from the toner supply opening 45.

As illustrated in FIG. 4, the inner surface along the circumference of the first container portion 33 ("inner circumferential surface" hereinafter) has a plurality of transport portions 36 for transporting the toner inside the toner container 31 in a direction along the cylinder axis. The transport portions 36 are provided to project out of the inner circumferential surface toward the cylinder axis. Further, the transport portions 36 are spaced apart from one another at predetermined intervals both in the circumferential direction and cylinder axis direction of the first container portion 33. In the cylinder axis direction, the transport portions 36 are formed parallel to one another.

In order to transport toner from the bottom portion 33*a* toward the third container portion 35, the transport portions 36 formed on the inner circumferential surface of the first toner portion 33 are tilted on a predetermined angle with respect to a direction perpendicular to the cylinder axis of the toner container 31. Specifically, each transport portion 36 is formed such that a portion thereof downstream with respect to the direction of rotation of the toner container 31 on the cylinder axis is closer than the upstream portion to the third container portion 35 having the toner outlet 43 (FIG. 5).

Figure 12:
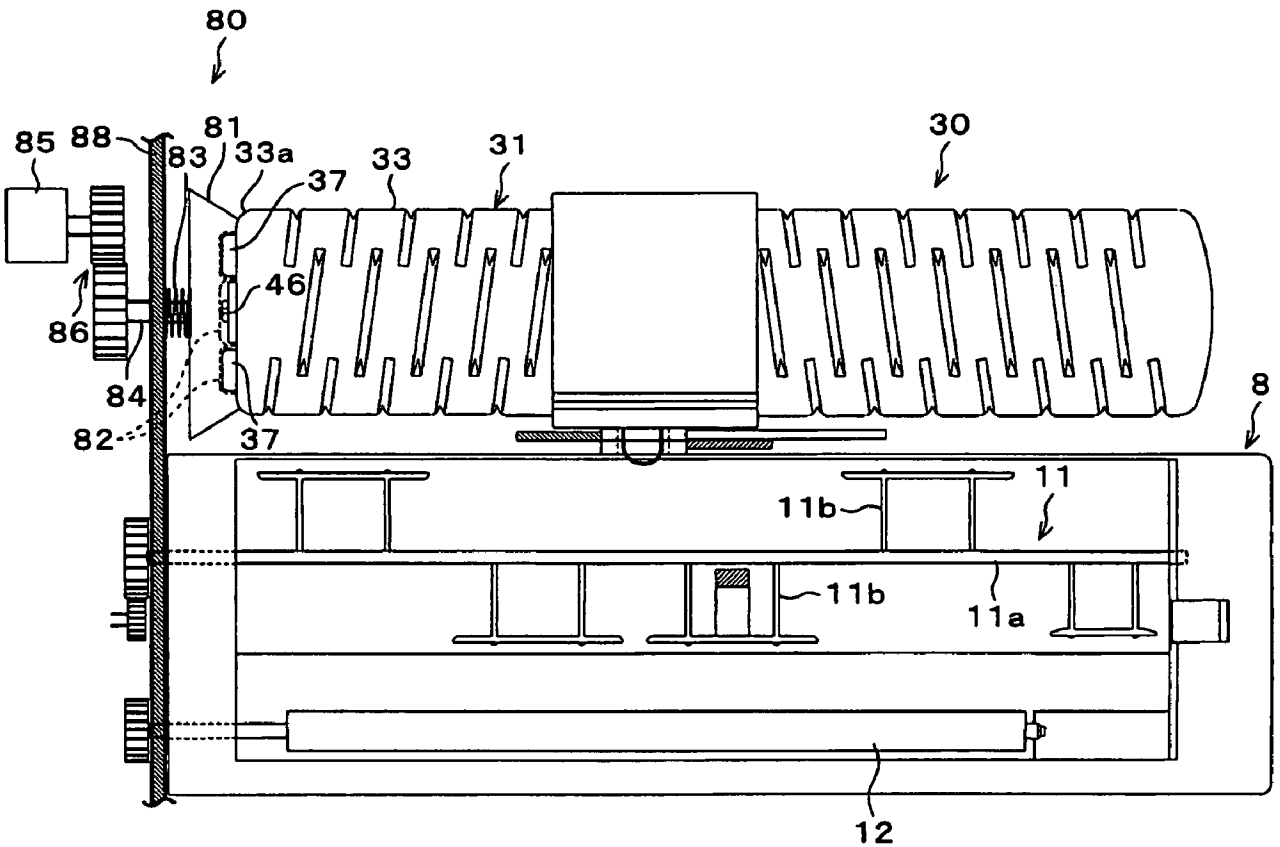
FIG. 12 is a top view showing the toner supply device shown in FIG. 1(*a*) and a main-body joint provided in a printer.

Further, the second container portion 34, as shown in FIG. 4, is provided on the opposite side of the toner container 31 from the main-body joint 80 provided in the printer 100 (see FIG. 12). The second container portion 34, closing the toner container 31 with its bottom portion 34*a*, is formed such that its inner diameter is equal to the inner diameter of the first container portion 33.

The inner circumferential surface of the second container portion 34 has a plurality of transport portions 39 for transporting the toner inside the toner container 31 in a direction along the cylinder axis. The transport portions 39 are provided to project out of the inner circumferential surface toward the cylinder axis. Further, the transport portions 39 are spaced apart from one another at predetermined intervals both in the circumferential direction and cylinder axis direction of the second container portion 34. In the cylinder axis direction, the transport portions 39 are formed parallel to one another.

In order to transport toner from the bottom portion 34*a* toward the third container portion 35, the transport portions 39 formed on the inner circumferential surface of the second container portion 34 are tilted on a predetermined angle with respect to a direction perpendicular to the cylinder axis of the toner container 31. Specifically, each transport portion 39 is formed such that a portion thereof downstream with respect to the direction of rotation of the toner container 31 on the cylinder axis is closer than the upstream portion to the third container portion 35 having the toner outlet 43 (FIG. 5).

As described above, the third container portion 35 is provided between the first container portion 33 and the second container portion 34 in the toner container 31. Accordingly, the transport portions 39 of the second toner container portion 34 and the transport portions 36 of the first container portion 33 are tilted in opposite directions. With the transport portions 36 and the transport portions 39, the rotation of the toner container 31 causes the toner respectively stored in the first container portion 33 and the second container portion 34 to be guided into the third container portion 35 from the respective bottom portions 33*a* and 34*b* of the toner container 31.

As shown in FIG. 4, the third container portion 35 has a greater inner diameter than the first container portion 33 and the second container portion 34. This ensures that the toner transported from the first container portion 33 and the second container portion 34 always moves into the third container portion 35, thereby always ensuring constant toner supply in the third container portion 35. With a predetermined amount of toner stored in the third container portion 35 after the rotation of the toner container 31, toner can be stably supplied at the start of rotation of the toner container 31. Further, because the amount of toner supply in the third container portion 35 can be maintained constant even when the amount of toner remaining in the toner container 31 has become small, toner can be stably supplied over an extended time period.

FIG. 5 is a perspective view showing the third container portion 35 in detail. As illustrated in FIG. 5, the third container portion 35 is formed around the toner container 31 along the direction of rotation of the toner container 31. The third container portion 35 has a recessed portion forming portion (recessed portion forming region) 35*a* and guide flap forming portions 35*b* and 35*c*, which are provided along the cylinder axis direction of the toner container 31. The recessed portion forming portion 35*a* is disposed between the guide flap forming portions 35*b* and 35*c*.

The recessed portion forming portion 35*a* has a first recessed portion (recessed portion) 41 and a second recessed portion 42, which are portions on the outer surface along the circumference of the third container portion 35 ("outer circumferential surface" hereinafter) depressed toward the cylinder axis. The first recessed portion 41 and the second recessed portion 42 are formed in the recessed portion forming portion 35*a* substantially symmetrical to each other about the cylinder axis. Further, the first recessed portion 41 and the second recessed portion 42 are spaced apart from each other by a predetermined distance in a rotational direction R of the toner container 31 about the cylinder axis.

The first recessed portion 41 provides a space for keeping ejected toner from the toner container 31. The first recessed portion 41 is also a space for transporting toner into a toner supply port (developer supply port) 50 (FIG. 6) to be described later. The first recessed portion 41 and the second recessed portion 42 are depressions on the outer circumferential surface of the third container portion 35 and therefore reduce the area of contact between the third container portion 35 and the support member 32 (FIG. 1) when the toner container 31 rotates. This reduces the friction between the supporting member 32 and the toner container 31 when the toner container 31 rotates, thus smoothly rotating the toner container 31.

As shown in FIG. 5, the first recessed portion 41 has an end wall 41*a*, a bottom wall 41*b*, and a first side wall 41*c*, and a second side wall 41*d*. The end wall 41*a* is at an end of the first recessed portion 41 downstream in the rotational direction R of the toner container 31, and is perpendicular to the outer circumferential surface of the recessed portion forming portion 35*a*. The toner outlet (outlet) 43 formed through the toner container 31 is provided in the end wall 41*a*, allowing the toner contained in the toner container 31 to be ejected into the first recessed portion 41.

The bottom wall 41*b* is provided along the rotational direction R, with its downstream end with respect to the rotational direction R continuous to the end wall 41*a*, and with its upstream end gradually continuing to the outer circumferential surface of the third container portion 35. That is, the bottom wall 41*b* is provided substantially parallel to the outer circumferential surface of the recessed portion forming portion 35*a*, and closer to the cylinder axis than the outer circumferential surface.

The first side wall 41*c* and the second side wall 41*d* of the first recessed portion 41 are provided at the respective ends of the toner container 31 with respect to the cylinder axis direction, parallel to each other and perpendicular to the bottom wall 41*b* and the outer circumferential surface of the recessed portion forming portion 35*a*. The first side wall 41*c* and the second side wall 41*d* are continuous to the end wall 41*a* on the downstream side in the rotational direction R of the toner container 31. On the upstream side, the first side wall 41*c* and the second side wall 41*d* are continuous to the outer circumferential surface of the third container portion 35.

On the other hand, the second recessed portion 42 has a bottom wall 42*b*, and a first side wall 42*c* and a second side wall 42*d*, as shown in FIG. 5. The bottom wall 42*b* is formed along the rotational direction R of the toner container 31, with its ends on the upstream and downstream sides of the rotational direction R gradually continuing to the outer circumferential surface of the third container portion 35. That is, the bottom wall 42*b* is substantially parallel to the outer circumferential surface of the third container portion 35, and closer to the cylinder axis than the outer circumferential surface.

The first side wall 42*c* and the second side wall 42*d* of the second recessed portion 42 are provided at the respective ends of the toner container 31 with respect to the cylinder axis direction, parallel to each other and perpendicular to the bottom wall 42*b* and the outer circumferential surface. Further, the first side wall 42*c* and the second side wall 42*d* are continuous to the outer circumferential surface of the third container portion 35 on the upstream and downstream sides in the rotational direction R.

The guide flap forming portion 35*b* defines an end of the third container portion 35 on the side of the first container portion 33. The ejection guide flaps 44*b* are formed along the outer circumferential surface of the guide flap forming portion 35*b* at predetermined regular intervals, parallel to one another. Further, the ejection guide flaps 44*b* are tilted at a predetermined angle with respect to the cylinder axis of the toner container 31, instead of being provided parallel thereto, so that the toner on the guide flap forming portion 35*b* can be desirably guided into the recessed portion forming portion 35*a* by the rotation of the toner container 31 on its cylinder axis.

The guide flap forming portion 35*b* defines an end of the third container portion 35 on the side of the first container portion 33. The ejection guide flaps 44*b* are formed along the outer circumferential surface of the guide flap forming portion 35*b* at predetermined regular intervals, parallel to one another. Further, the ejection guide flaps 44*b* are tilted at a predetermined angle with respect to the cylinder axis of the toner container 31, instead of being provided parallel thereto, so that the toner on the guide flap forming portion 35*b* can be desirably guided into the recessed portion forming portion 35*a* by the rotation of the toner container 31 on its cylinder axis.

The guide flap forming portion 35*c* defines an end of the third container portion 35 on the side of the second container portion 34. The ejection guide flaps 44*c* are formed along the outer circumferential surface of the guide flap forming portion 35*c* at predetermined regular intervals, parallel to one another. Further, the ejection guide flaps 44*c* are tilted at a predetermined angle with respect to the cylinder axis of the toner container 31, instead of being provided parallel thereto, so that the toner on the guide flap forming portion 35*c* can be desirably guided into the recessed portion forming portion 35*a* by the rotation of the toner container on its cylinder axis. Note that, the ejection guide flaps 44*b* and 44*c* are tilted in opposite directions.

The third container portion 35 also has a seal 62 for sealing the toner outlet 43 of the first recessed portion 41, as shown in FIG. 5. One end of the seal 62 is stuck on the toner outlet 43 of the first recessed portion 41 to seal the opening, while the other end is fixed on the scraper 20 (see FIG. 6). The seal 62 may be made of a material such as polyethylene terephthalate (PET). However, the material of the seal 62 is not just limited to PET and any material can be used as long as it can provide adhesion to seal the toner outlet 43. Examples of such materials include polyethylene, polypropylene, and nonwoven fabric.

As illustrated in FIG. 1, the support member 32 supports the third container portion 35 of the toner container 31 so as to allow for rotation on the cylinder axis L, as a rotation axis. Preferably, the support member 32 supports the toner container 31 by surrounding at least the entire area of the recessed portion forming portion 35*a* of the third container portion 35.

Figure 6:
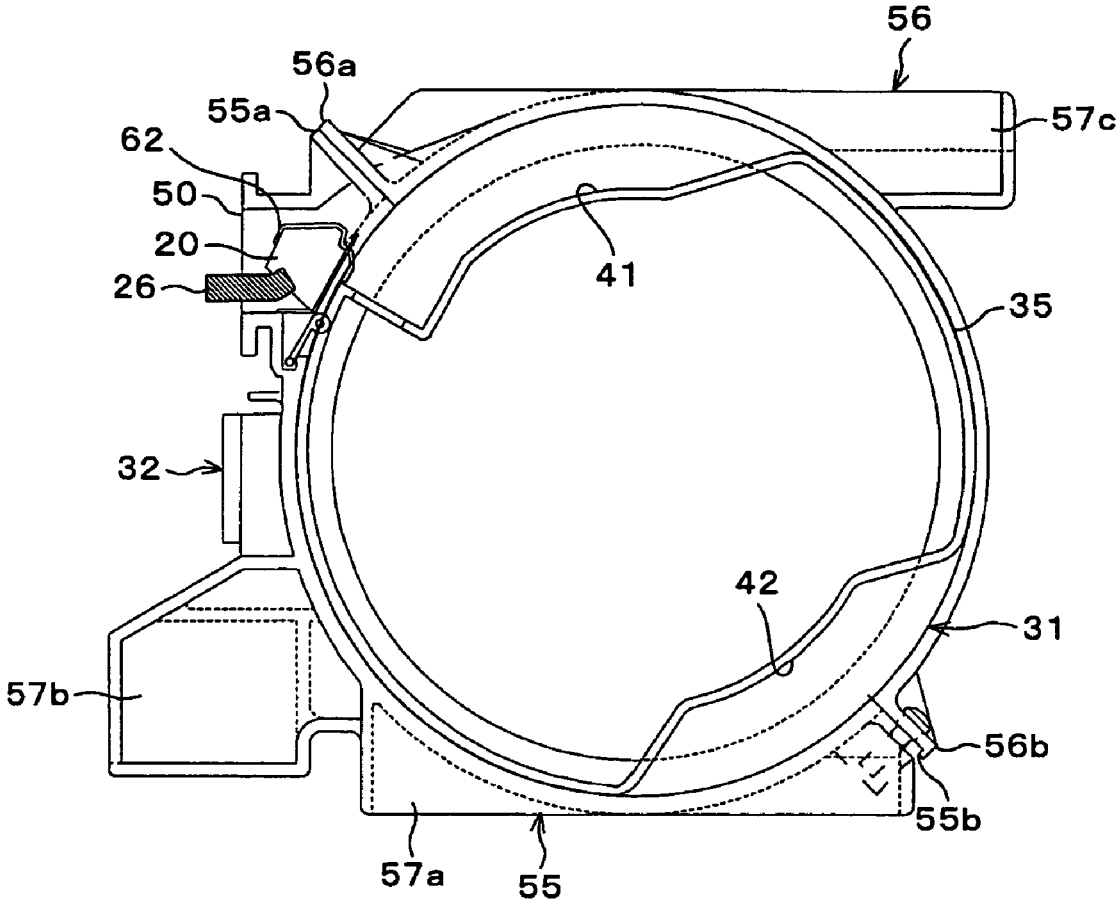
FIG. 6 is a longitudinal sectional view showing the third container portion and the support member of the toner supply device shown in FIG. 1(*a*).

FIG. 6 is a cross section illustrating the third container portion 35 and the support member 32. As shown in FIG. 6, the support member 32 includes a first support portion 55 and a second support portion 56. The first support portion 55 and the second support portion 56 together form a cylindrical space concentric to the cylinder axis of the toner container 31. With the third container portion 35 placed in the space, the first support portion 55 and the second support portion 56 surround the entire outer circumferential surface of the third container portion 35 and thereby support the toner container 31. Note that, the support member 32 supports the toner container 31 by surrounding the outer circumferential surface of the third container portion 35, including at least the recessed portion forming portion 35*a*.

The first support portion 55 and the second support portion 56 have round surfaces with curvatures according to the cylindrical shape of the third container portion 35. In the present embodiment, the first support portion 55 and the second support portion 56 with their round surfaces surround the outer circumferential surface of the third container portion 35, each covering half of the third container portion 35. In this way, the first support portion 55 and the second support portion 56 create the cylindrical space for supporting the toner container 31.

In order to provide such a cylindrical space, the first support portion 55 has joint portions 55*a* and 55*b* respectively at the both ends of its round surface with respect to the circumferential direction, as illustrated in FIG. 6. The joint portions 55*a* and 55*b* are perpendicular to the round surface and extend in a lengthwise direction of the cylinder. The second support portion 56 has joint portions 56*a* and 56*b* respectively at the both ends of its round surface with respect to the circumferential direction. The joint portions 56*a* and

56*b* are perpendicular to the round surface and extend in a lengthwise direction of the cylinder. The joint portions 55*a* and 55*b* of the first support portion 55 are in contact with the joint portions 56*a* and 56*b* of the second support portion 56, respectively, and are fixed thereto with a fixing member such as a screw. In this way, the inner round surface of the first support portion 55 meets the inner round surface of the second support portion 56, creating the cylindrical space.

Figure 7:
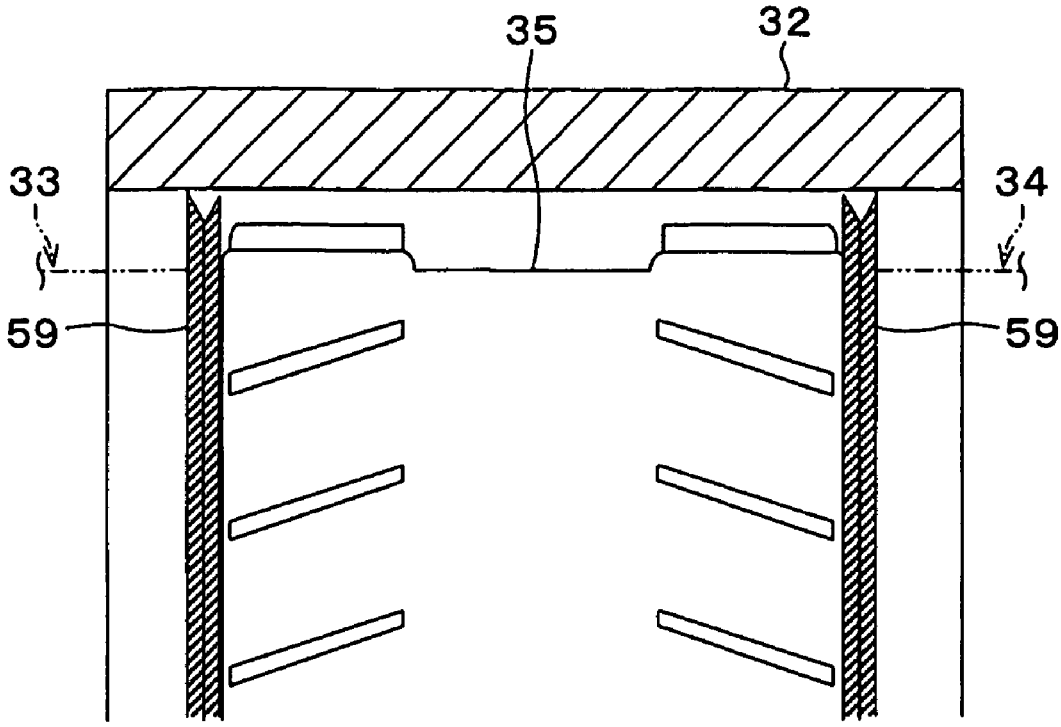
FIG. 7 is a cross sectional view showing a state where a V-seal is provided between the third container portion and the support member of the toner supply device shown in FIG. 1(*a*).

In order to support the toner container 31 with the support member 32, a V-seal 59 having a V-shape cross section is provided between the toner container 31 and the first and second support portions 55 and 56 of the support member 32, as illustrated in FIG. 7. The V-seal 59 may be made of an elastic material such as silicon rubber, for example. In the present embodiment, as shown in FIG. 7, owning to the fact that the support member 32 has a greater width (lengthwise width along the cylinder axis) than the third container portion 35, the V-seal 59 is wound along the circumference of the boundary portion between the first container portion 33 and the third container portion 35 and between the second container portion 34 and the third container portion 35, so as to close the gap between the toner container 31 and the support member 32.

By closing the gap between the toner container 31 and the support member 32 with the V-seal 59, the toner container 31 and the support member 32 can provide improved air-tightness. This prevents toner from spreading onto the first container portion 33 or the second container portion 34 even when toner leaks out of the space between the toner container 31 and the support member 32 during toner transport from the toner container 31 through the toner supply port 50 (FIG. 6, described later) of the support member 32. As a result, scattering of toner inside the printer 100 can be prevented.

Further, as illustrated in FIG. 6, the first support portion 55 and the second support portion 56 of the support member 32 include mount guide portions 57*b* and 57*c*, formed respectively on the round surfaces of the first support portion 55 and the second support portion 56. The mount guide portions 57*b* and 57*c* are provided to mount the toner supply device 30 in the image forming apparatus. The first support portion 55 further includes a rib 57*a*. The rib 57*a* serves as a mount guide portion when the toner supply device 30 is to be mounted in the image forming apparatus. When the toner supply device 30 is to be placed on an external surface of the printer 100, the rib 57*a* serves as a base, preventing the toner container 31 from rolling.

The first support portion 55 also has the toner supply port (developer supply port) 50, through which toner is transported to a toner opening provided on the toner hopper 8 side (FIG. 3, described later).

Figure 8:
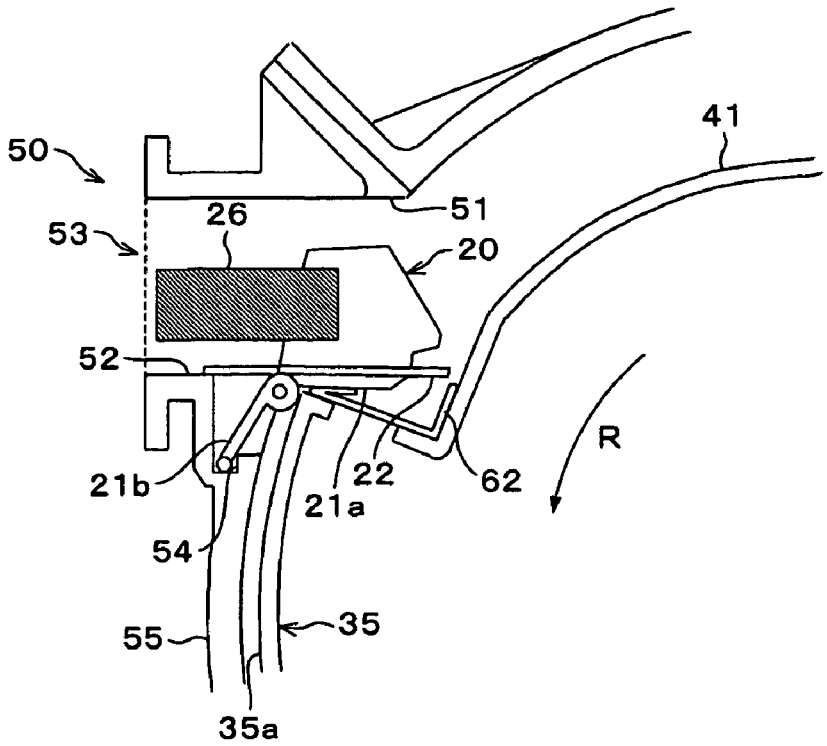
FIG. 8(*a*) is a cross sectional view showing a state where a toner ejecting sheet is positioned in a first recessed portion of the toner container shown in FIG. 1(*a*).
Figure 8:
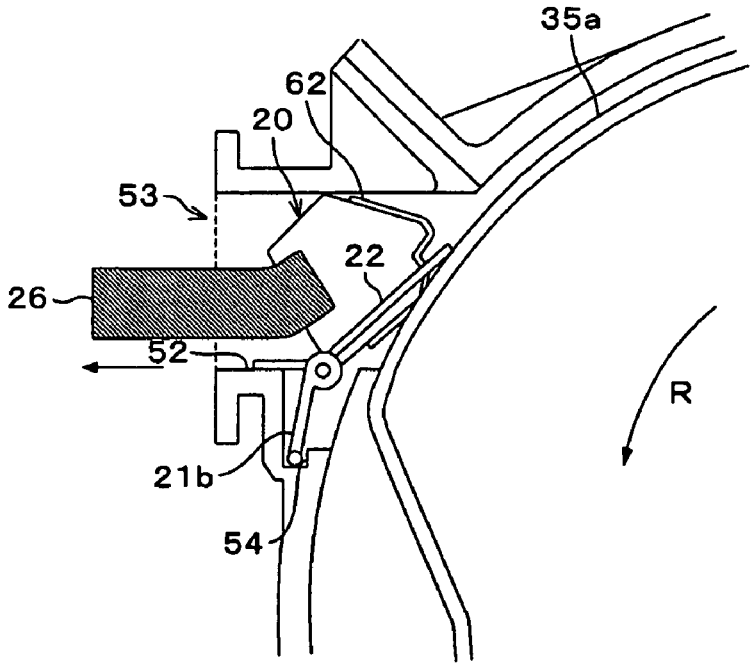
Figure 9:
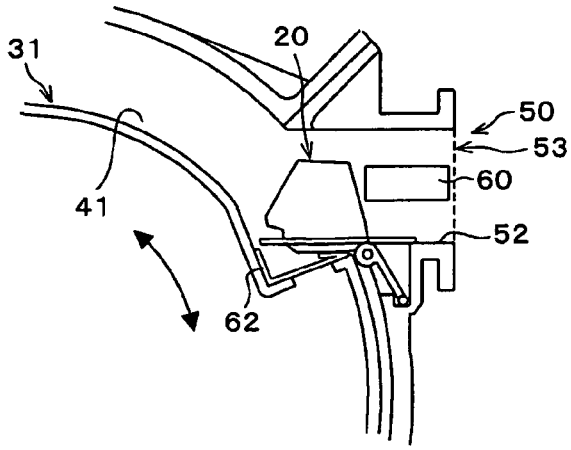
FIG. 9(*a*) is a cross sectional view showing the structure of the toner supply port and its peripheral area in the toner supply device shown in FIG. 1(*a*).
Figure 9:
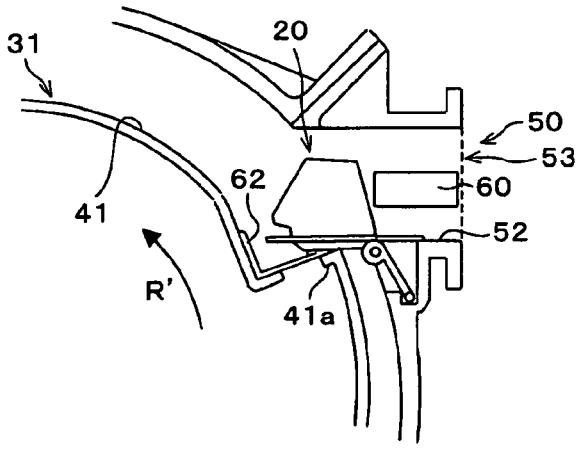
Figure 9:
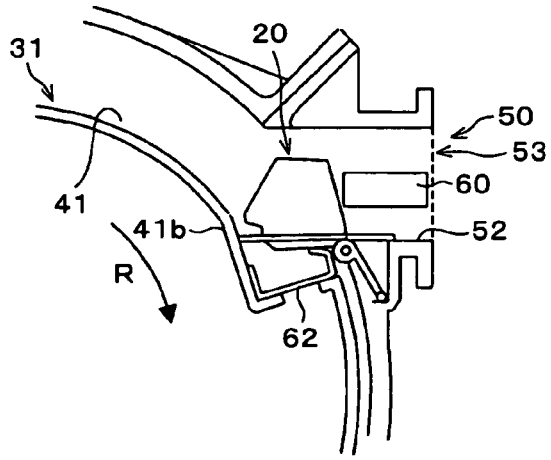

FIGS. 8(*a*) and 8(*b*) and FIGS. 9(*a*) through 9(*c*) are cross sectional views illustrating an area in the vicinity of the toner supply port 50. FIGS. 8(*a*) and 8(*b*) are cross sections in the vicinity of the toner supply port 50 as viewed from the first container portion 33 side, showing a blocking preventing member 26 along with the other members. FIGS. 9(*a*) through 9(*c*) are cross sections in the vicinity of the toner supply port 50 as viewed from the second container portion 34 side, showing the stopping member 60 along with the other members.

As shown in FIG. 8(*a*), the toner supply port 50 has an opening 51, a toner transport path 52, and the opening 53. The opening 51 is formed through the round surface of the first support portion 55, and the opening 53 faces the toner hopper 8. The toner supplied from the toner container 31 is transported out of the toner supply device 30, i.e., to the toner hopper 8, through the opening 51, the toner transport path 52, and the opening 53. As shown in FIG. 3, the toner supply port 50 is provided such that it is above the cylinder axis L of the toner container 31 when the toner supply device 30 is installed in the printer 100.

The toner supply port 50 also has the scraper (scraping member) 20 for scraping the toner supplied from the toner container 31. The scraper 20 in the toner supply port 50 faces the toner container 31, and slides along the outer circumferential surface of the recessed portion forming portion 35*a* of the third container portion 35 (FIG. 5).

FIGS. 9(*a*) through 9(*c*) are cross sectional views in the vicinity of the toner supply port 50, showing a state in which the stopping member 60 projects into the opening 53 (i.e., the shutter plate 58*a* is closed). As shown in FIG. 9(*a*), the stopping member 60 is positioned such that it pushes the scraper 20 and thereby maintains the scraper 20 in the position projecting toward the first recessed portion 41 of the toner container 31. That is, the stopping member 60 moves into the opening 53 of the toner supply port 50, and holds the scraper 20 by pushing it toward the first recessed portion 41, thereby regulating the sliding of the scraper 20 (see FIGS. 9(*b*) and 9(*c*)). As to the movement of the stopping member 60, more detail will be described later.

Figure 10:
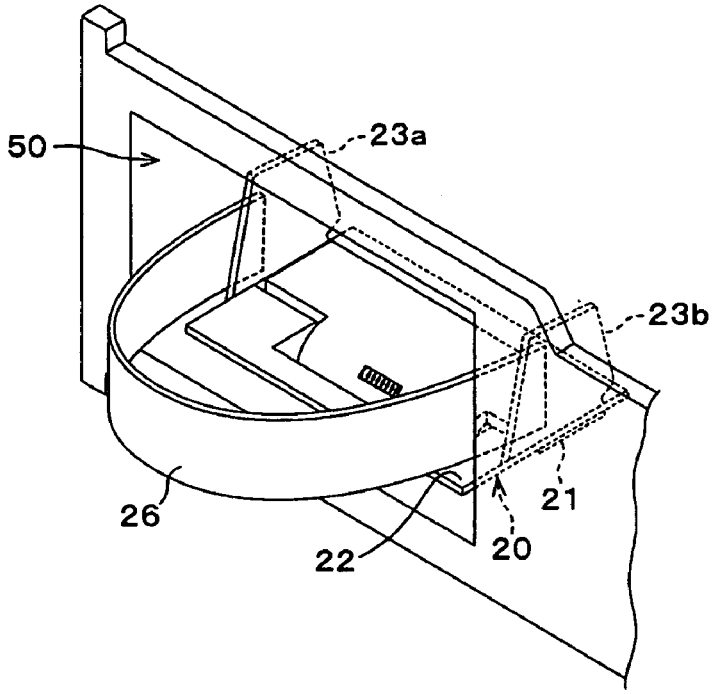
FIG. 10(*a*) is a perspective view showing the toner supply port as viewed from a toner hopper side in the toner supply device shown in FIG. 1(*a*).
Figure 10:
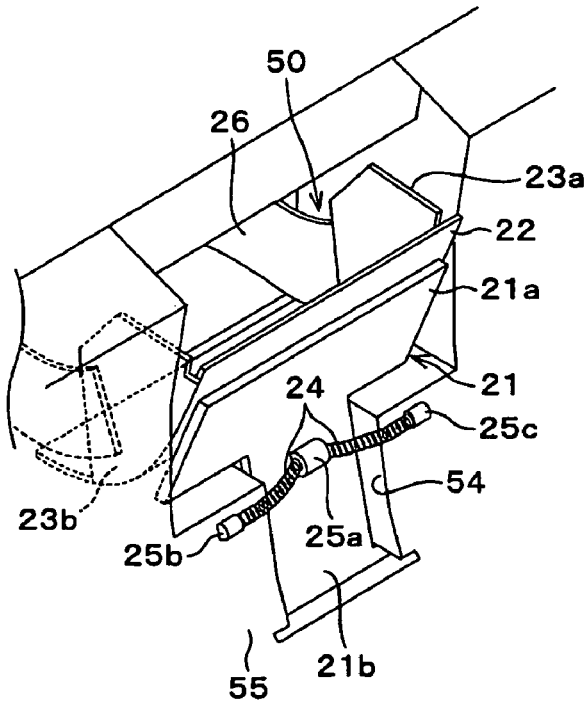

FIG. 10(*a*) is a perspective view showing the toner supply port 50 as viewed from the toner hopper 8 side. FIG. 10(*b*) is a perspective view showing the toner supply port 50 as viewed from the toner container 31 side. As illustrated in FIG. 10(*a*) and FIG. 10(*b*), the scraper 20 includes a base portion 21, a toner ejecting sheet 22, and walls 23*a* and 23*b*.

As shown in FIG. 10(*b*), the base portion 21 is a rigid body made of polyacetal resin and the like, and includes a sheet hold portion 21*a* and a fulcrum portion 21*b*. The sheet hold portion 21*a* holds a sliding end of the toner ejecting sheet 22 sliding on the recessed portion forming portion 35*a* (FIG. 5). The fulcrum portion 21*b* acts as a fulcrum for the scraper 20 when the scraper 20 slides on the recessed portion forming portion 35*a*. Further, the sheet hold portion 21*a* is provided to support the toner ejecting sheet 22, so that the toner ejecting sheet 22 will not deform (for example, will not be bent) even when an end of the toner ejecting sheet 22 is brought into contact with the recessed portion forming portion 35*a* by the movement of the scraper 20.

The fulcrum portion 21*b* extends from the sheet hold portion 21*a* with a predetermined angle relationship with the sheet hold portion 21*a*. As shown in FIG. 8(*a*), an end of the fulcrum portion 21*b* opposite the sheet hold portion 21*a* is inserted in a scraper mount portion 54, which is a recessed portion provided downstream with respect to the rotational direction of the toner container 31. The movement at this end of the fulcrum portion 21*b* is restricted in the scraper mount portion 54.

As shown in FIG. 10(*b*), in the base portion 21, the fulcrum portion 21*b* on the side facing the toner container 31 has a retaining member 25*a* retaining an elastic member 24 such as a spring. The both ends of the elastic member 24 are retained by retaining members 25*b* and 25*c*, respectively, with respect to the first support portion 55. With the elastic member 24 provided for the fulcrum portion 21*b*, the fulcrum portion 21*b* side of the base portion 21 of the scraper 20 is pulled toward the third container portion 35 of the toner container 31 on an angle. Thus, when the front end of the toner ejecting sheet 22 is not in contact with the recessed portion forming portion 35*a* (FIG. 5), the sheet hold portion 21*a* of the base portion 21 is held toward the third container portion 35, as shown in FIG. 8(*a*).

In this state, when the toner container 31 rotates in the rotational direction R, the front end of the toner ejecting sheet 22 is brought into contact with the outer circumferential surface of the recessed portion forming portion 35*a* and pressed against it. Accordingly, the scraper 20 rotates on the fulcrum portion 21*b* mounted on the scraper mount portion 54, so that the front end of the toner ejecting sheet 22 slides along the outer circumferential surface of the recessed portion forming portion 35*a*.

The toner ejecting sheet 22 is elastic, and made of a highly flexible material such as polyethylene terephthalate (PET). As shown in FIG. 10(*b*), the toner ejecting sheet 22 is fixed on the sheet hold portion 21*a* of the base portion 21 using, for example, a double-sided adhesion tape. Further, as shown in FIG. 8(*a*), the toner ejecting sheet 22 is positioned such that its end extending toward the fulcrum portion 21*b* of the base portion 21 is on the toner transport path 52, covering the scraper mount portion 54 and thereby preventing toner from entering the scraper mount portion 54 provided on the toner supply port 50.

By being elastic and flexible, the toner ejecting sheet 22 can slide along the recessed portion forming portion 35*a* with its front end pressed against the recessed portion forming portion 35*a*. By being able to slide, the toner ejecting sheet 22 can bend between the sheet hold portion 21*a* and the fulcrum portion 21*b* and can slide on the toner transport path 52 above the scraper mount portion 54, as shown in FIG. 8(*b*), when the sheet hold portion 21*a* of the base portion 21 is lifted up.

The walls 23*a* and 23*b* are provided on the sides of the toner ejecting sheet 22 with respect to the transport direction of toner, and are provided perpendicular to the toner ejecting sheet 22, as shown in FIG. 10(*a*), so that the toner ejected through the opening 51 (FIG. 8(*a*)) can be desirably transported to the toner transport path 52. The toner ejecting sheet 22 and the walls 23*a* and 23*b* may be formed in one piece. In this case, for example, end portions of an elastic resin sheet are bent to provide the toner ejecting sheet 22 and the walls 23*a* and 23*b*.

In order to ensure toner flow in the toner transport path 52, the blocking preventing member 26 is provided for the scraper 20, as shown in FIG. 8(*a*). The blocking preventing member 26 has an arc shape with its both ends respectively fixed to the walls 23*a* and 23*b* of the scraper 20, as shown in FIG. 10(*a*). Further, the blocking preventing member 26 is provided on the toner transport path 52.

Figure 17:
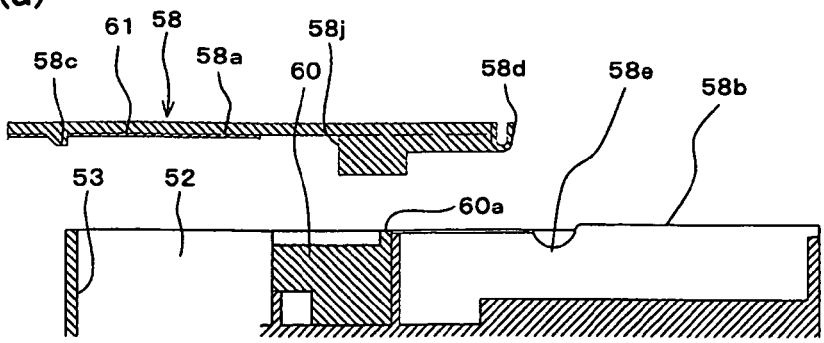
FIG. 17(*a*) is a cross sectional view showing a state where a shutter plate is separated from a shutter plate guide in the shutter included in the toner supply device shown in FIG. 1(*a*).
Figure 17:
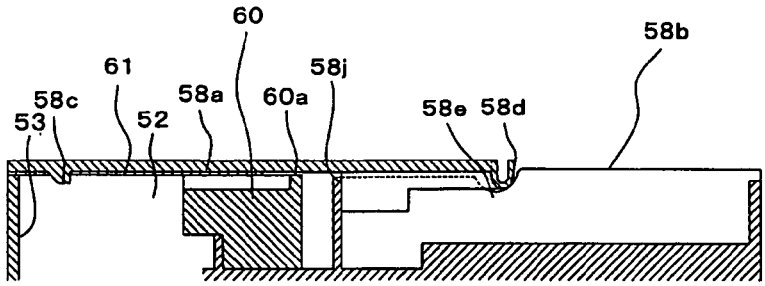
Figure 17:
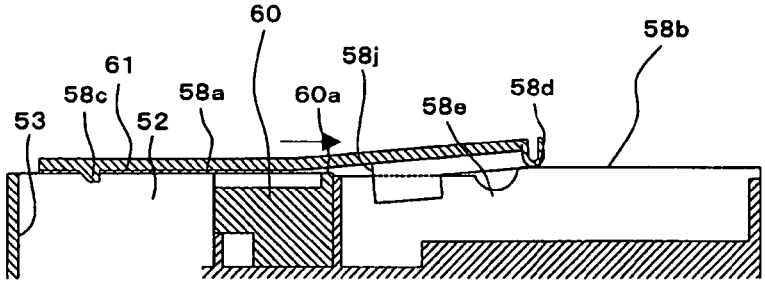
Figure 17:
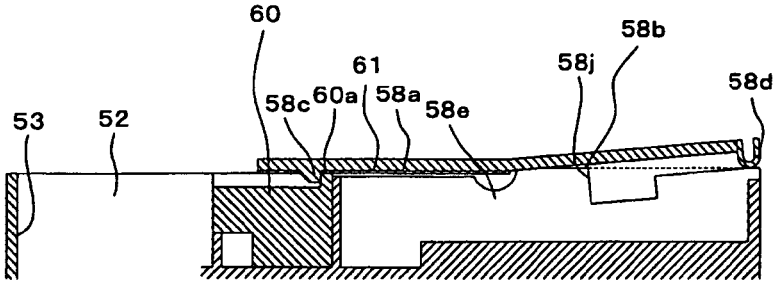
Figure 17:
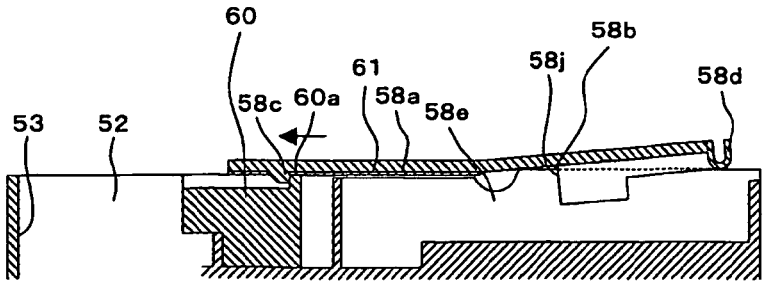

Though detailed description will be made later, the stopping member 60 escapes from the toner transport path 52 when the shutter 58 is open, as shown in FIG. 17(*d*). With the shutter 58 closed, the stopping member 60 projects into the toner transport path 52 provided behind the scraper 20, positioning itself behind the scraper 20, i.e., on the toner supply port 50 side. When moving the shutter 58 for opening or closing, the scraper 20 projects out of the toner supply port 50 into the first recessed portion 41 side, as shown in FIG. 9. The blocking preventing member 26 is provided on the scraper 20 in such a manner that it does not hinder the pushing of the scraper 20 or the movement of the stopping member 60 projecting into the opening 53 side.

The blocking preventing member 26 is prepared as a sheet by molding, for example, polyethylene terephthalate (PET), acrylonitrile butadiene styrene (ABS) resin, polyolefin, and the like. It is preferable that the blocking preventing member 26 have a thickness in a range of 50 μm to 200 μm, and be elastic. By being prepared from an elastic material molded into a thin sheet, the blocking preventing member 26 can freely undergo elastic deformation, thus improving flexibility of the blocking preventing member in terms of its shape.

Thus, by the pressure of the stopping member 60, the blocking preventing member 26 deforms according to the shape of the scraper 20, and therefore does not interfere with the stopping member 60 when the stopping member 60 projects into the opening 53 to push the scraper 20.

As shown in FIG. 8(*a*) and FIG. 8(*b*), the blocking preventing member 26 moves above the toner transport path 52 in the transport direction of toner by interlocking with the movement of the scraper 20. This enables the toner on the toner transport path 52 to be pushed onto the toner hopper 8 side through the opening 53 of the toner supply port 50, thereby preventing the toner from being stuck on the toner transport path 52.

Figure 11:
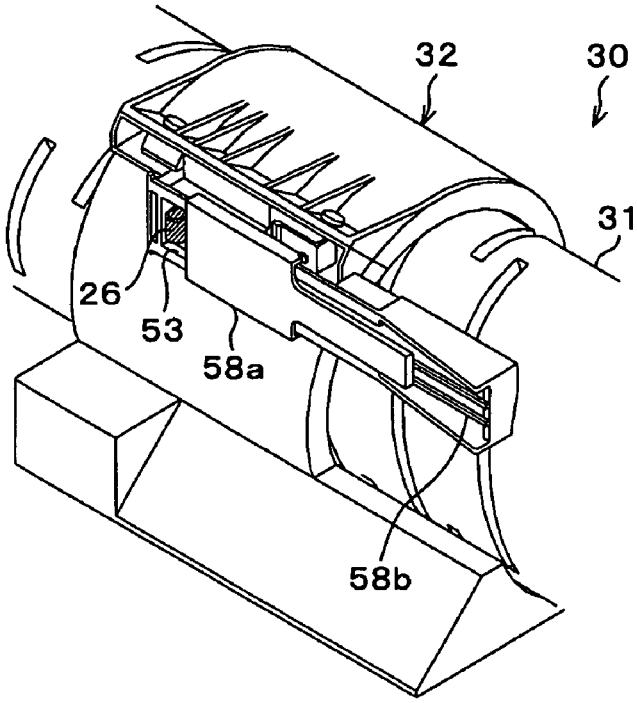
FIG. 11(*a*) is a perspective view showing the movement of a shutter in the process of detaching the toner supply device shown in FIG. 1(*a*) from the printer.
Figure 11:
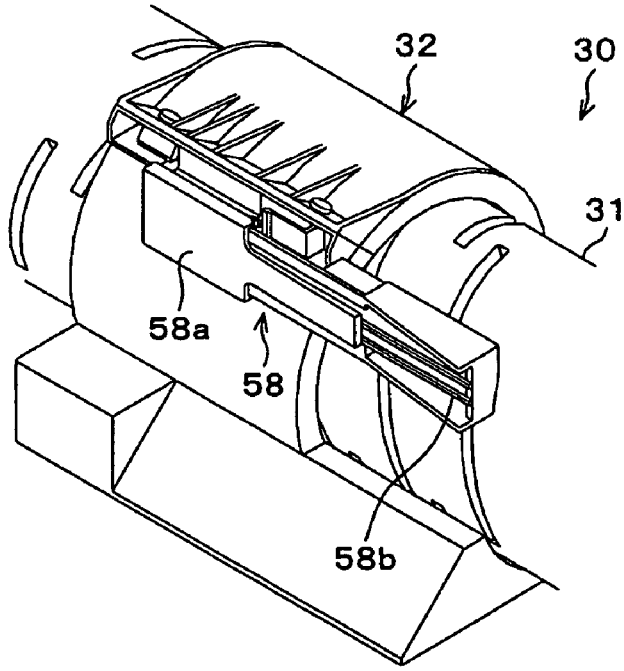

As illustrated in FIG. 1, the toner supply port 50 has the shutter 58 for opening or closing the opening 53 provided on the toner hopper 8 side of the toner supply port 50. As described earlier, the shutter 58 includes the shutter plate 58*a* for covering the toner supply port 50, and the shutter plate guide 58*b* for allowing the shutter plate 58*a* to slide in a direction parallel to the cylinder axis of the toner container 31. With the toner supply device 30 installed in the printer 100 (FIG. 2), the shutter 58 opens the opening 53 of the toner supply 50, as shown in FIG. 1(*a*). When detaching the toner supply device 30 from the printer 100, the shutter plate 58*a* slides along the shutter plate guide 58*b* as the toner supply device 30 is detached, as shown in FIG. 11(*a*). With the blocking preventing member 26 housed in the toner supply port 50, the shutter plate 58*a* covers the opening 53 of the toner supply 50, as shown in FIG. 11(*b*).

The toner supply device 30 as structured above is detachably provided in the printer 100. When installing the toner supply device 30 in the printer 100, the toner supply device 30 is inserted in the vicinity of the toner hopper 8 in the printer 100, as shown in FIG. 2. This is carried out by inserting the first container portion 33 end (FIG. 4) of the toner container 31 into the printer 100, and by guiding the toner supply device 31 along the rib 57*a* and the mount guide portions 57*b* and 57*c* (FIG. 6).

When the toner supply device 30 is not installed in the printer 100, the shutter 58 covers the opening 53 of the toner supply port 50 and closes it, as shown in FIG. 11(*b*). As such, a shutter displacing member (not shown) is provided in a mount area of the printer 100 where the toner supply device 30 is mounted. In this way, when installing the toner supply device 30 in the printer 100, the shutter plate 58*a* of the shutter 58 provided on the support member 32 of the toner supply device 30 slides and thereby opens the toner supply port 50, as shown in FIG. 1. By installing the toner supply device 30 in the printer 100 in this manner, the shutter 58 slides and the toner supply port 50 opens, thereby connecting the opening 53 of the toner supply port 50 to the toner supply port (not shown) of the toner hopper 8.

Figures 18A, 18B, 18C, 18D, 18E, 18F, 18G, 18H:
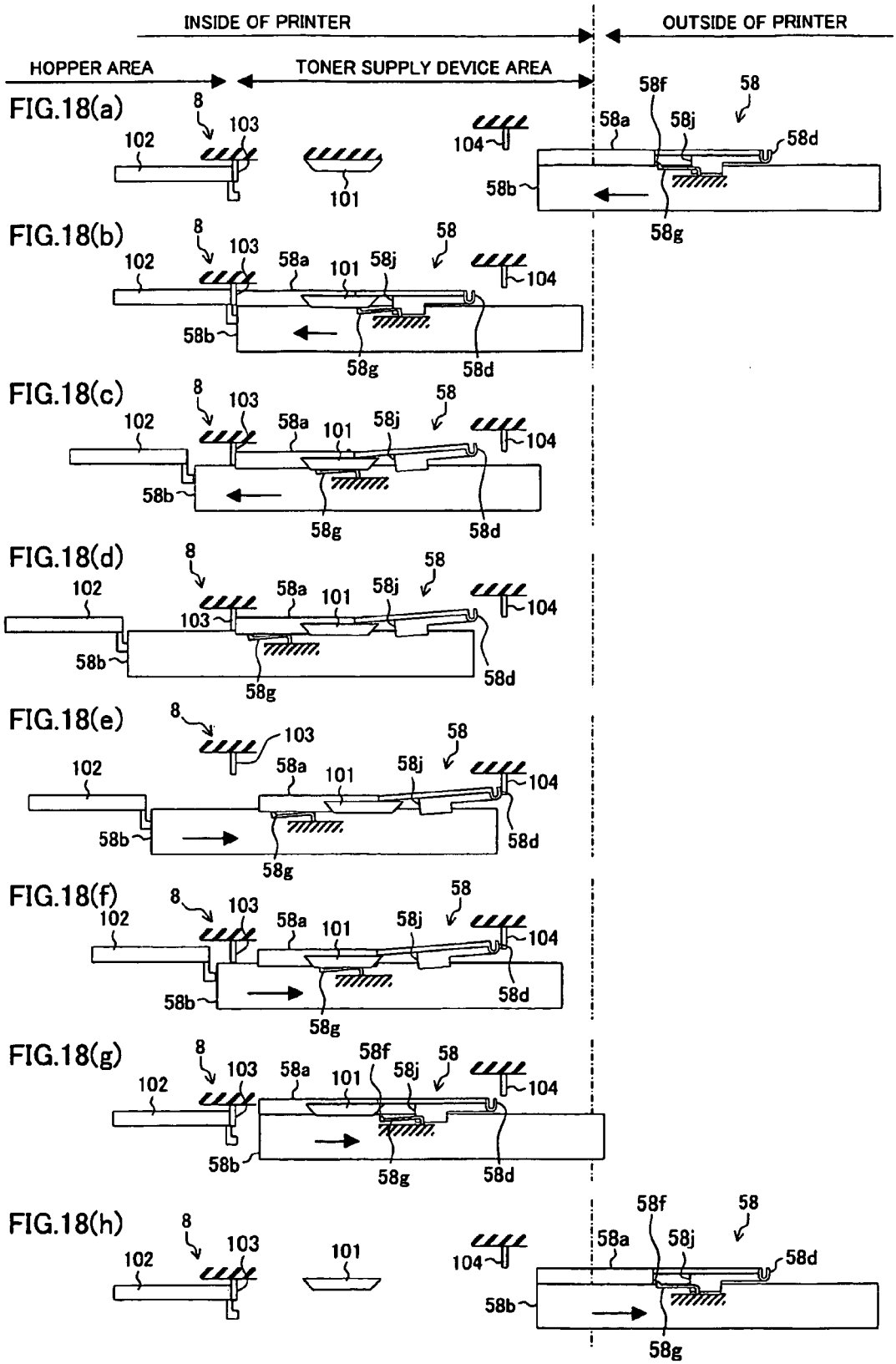
FIG. 18(*a*) illustrates opening and closing of the shutter when the toner supply device shown in FIG. 1(*a*) is installed in the printer, and is a cross sectional view showing a state at the start of installation.
Figure 19:
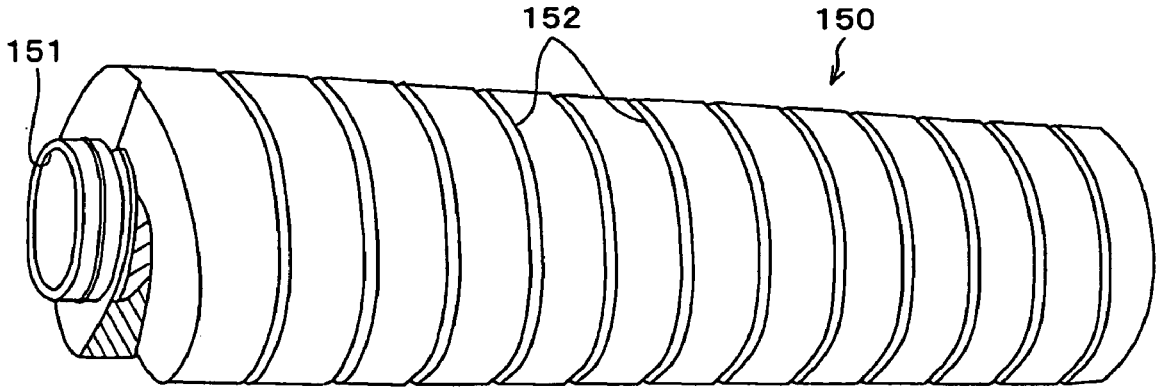
FIG. 19 is a perspective view showing the conventional toner container.

Next, with reference to FIG. 18, the following will describe opening and closing operations of the shutter plate 58*a* in detaching/attaching the toner supply device 30 from/to the printer 100. FIG. 18 is a diagram illustrating opening and closing operations of the shutter 58 in installing the toner supply device 30 in the printer 100. For convenience of explanation, FIG. 18 illustrates only the shutter 58 in the toner supply device 30.

As shown in FIG. 18(*a*), in the toner supply device 30 before being installed in the printer 100, the shutter plate 58*a* is closed. At the present case, the locking pawl 58*f* provided on the shutter plate 58*a* is stopped by the stopper 58*g* provided on the shutter plate guide 58*b*. That is, the stopper 58*g* serves to prevent the shutter plate 58*a* from being opened accidentally.

When being installed in the printer 100, the toner supply device 30 is moved so as to slide in parallel with the rotation axis of the toner container 31 from the outside of the printer 100 to a toner supply device area. At the present case, as shown in FIG. 18(*b*), a rib 101 fixed to the hopper 8 pushes down the stopper 58*g* toward the toner container 31. This releases stopping of the locking pawl 58*f* by the stopper 58*g*. Therefore, when stopping of the shutter plate 58*a* by the stopper 58*g* is released, the shutter plate 58*a* becomes movable.

Then, as shown in FIG. 18(*c*), when the toner supply device 30 reaches a hopper area inside the printer 100, an end of a hopper shutter 102, provided on the hopper 8 side, for closing the toner supply port of the hopper 8 comes into contact with the shutter 58 as well as the end of the shutter plate 58*a* comes into contact with an opening pawl 103 firmly disposed to the hopper 8 side. Further, when the toner supply device 30 is moved in the hopper area, the hopper shutter 102 moves in the hopper area along with the toner supply device 30. This opens the toner supply port of the hopper 8. Further, the opening pawl 103 causes the shutter plate 58*a* to slide in an opposite direction to the movement direction of the shutter 58, i.e. in an opening direction of the shutter plate 58*a*. This opens the shutter plate 58*a*. That is, the toner supply port 50 of the toner supply device 30 is opened.

Then, as shown in FIG. 18(*d*), when the hopper shutter 102 and the shutter plate 58*a* become completely open, the toner supply device 30 comes into contact with a stopper (not shown) in the printer 100 and stops. This completes installing operation of the shutter 58 to the printer 100. At the present case, the toner supply port 50 and the toner supply port of the hopper 8 face each other.

On the other hand, as shown in FIG. 18(*e*), when the toner supply device 30 having been installed in the printer 100 is detached, the hopper shutter 102 moves along with the toner supply device 30 by a force applied from a spring (not shown). That is, the hopper shutter 102 moves with movement of the toner supply device 30 to the outside of the printer 100. This closes the toner supply port of the hopper 8. When the toner supply port of the hopper 8 is closed, the hopper shutter 102 comes into contact with a stopper (not shown) on the hopper side and stops.

When the toner supply device 30 is moved in the direction of removal from the printer 100, as shown in FIG. 18(*f*), the elastic end portion 58*d* provided to shutter plate 58*a* being pushed up toward the toner container 31 side by the shutter plate guide 58*b* comes into contact with a closing pawl 104 which is firmly provided to the hopper 8. When the toner supply device 30 is further moved, the shutter plate guide 58*b* moves in a direction of removal of the toner supply device 30, but the shutter plate 58*a* stopped by the closing pawl 104 does not move. Therefore, the shutter plate 58*a* moves relatively to the shutter plate guide 58*b*, whereby the shutter plate 58*a* is closed. Further, the elastic end portion 58*d* that can undergo elastic deformation gets snagged in the closing pawl 104 on the hopper 8 side, whereby the elastic end portion 58*d* does not go down to the shutter plate guide 58*b* side. This prevents the occurrence of the problem that the shutter plate 58*a* is not closed.

Then, as shown in 18(*g*), when the opening 53 is completely closed by the shutter plate 58*a*, the shutter 58 comes into contact with a stopper (not shown) of the shutter 58, thus prohibiting a further relative movement of the shutter plate 58*a*. Further, the stopper 58*g* having been pushed down to the toner container 31 side is released by the rib 101, so that the stopper 58*g* is pushed up to the opposite direction of the toner container 31 side. With this arrangement, the stopper 58*g* stops the locking pawl 58*f*, thus preventing the shutter plate 58*a* from being opened accidentally for user's operating error and other reasons.

Then, the elastic end portion 58*d* is fitted again to the notch 58*e* of the shutter plate guide 58*b*. With application of a force to the elastic end portion 58*d* when relative movement of the shutter plate 58*a* and the shutter plate guide 58*b* is prohibited, the elastic end portion 58*d* undergoes elastic deformation. This frees from unmoving of the shutter plate 58*a* caused when the elastic end portion 58*d* gets snagged in the notch 58*e*, and frees from damage to the shutter plate 58*a* due to application of an excessive load to the shutter plate 58*a*. This allows the shutter plate 58*a* to be opened or closed without any trouble, so that the toner supply device 30 can be detached smoothly from the printer 100.

As shown in FIG. 18(*h*), the toner supply device 31 is completely detached from the printer 100 with the shutter plate 58*a* closed completely. At the present case, the U-shape end portion 58*d* fits the notch 58*e*, and the stopper 58*g* restricts accident opening of the shutter plate 58*a*.

In this manner, opening and closing operations of the shutter plate 58*a* are performed in detaching and attaching the toner supply device 30 from and to the printer 100.

Next, as to the operation of the stopping member 60 in opening and closing operations of the shutter 58, detailed description will be made below with reference to FIGS. 17(*a*) through 17(*e*).

As mentioned above, the stopping member 60 is held on the shutter plate guide 58*b* of the shutter 58 such that it can move parallel to the opening and closing direction of the shutter plate 58*a*. Further, as shown in FIG. 17(*a*), the stopping member 60 is provided with an end wall (projection) 60*a* on its surface facing the shutter plate 58*a* and being opposite to the opening 53, i.e. at the end of the stopping member 60 in the opening direction of the shutter plate 58*a*. The end wall 60*a* is provided so as to project in the direction of the shutter plate 58*a*. Further, the shutter plate 58*a* on the back surface of the opening covering portion 58*h* is bonded with the felt 61 and has the projection 58*c* which is provided so as to engage with the end wall 60*a*. Meanwhile, the shutter plate 58*a* on the back surface of the slider portion 58*i* has a plate projection 58*j*, which stands substantially perpendicular to the plane of the back surface.

Further, when the toner supply device 30 is not in use and is not installed in the printer 100 (image forming apparatus), the shutter plate 58*a* covers the opening 53 of the toner supply port 50 and is closed.

FIG. 17(*b*) illustrates the shutter plate 58*a* being closed. At this moment, the stopping member 60 projects into the opening 53 side, and the elastic end portion 58*d* is fitted to the notch 58*e* provided on the shutter plate guide 58*b*. With the elastic end portion 58*d* projected out, when the toner container 31 is removed from the developer supply device 30, the elastic end portion 58*d* comes into collision with other objects. This could cause detachment and breakage of the shutter plate 58*a*, resulting in breakdown of the shutter 58. However, according to the present invention, the elastic end portion 58*d* is fitted to the notch 58*e* and is retracted, thus preventing damage to the shutter 58.

Next, as shown in FIG. 17(*c*), when the shutter plate 58*a* is moved in the opening direction (in the direction indicated by an arrow in FIG. 17(*c*)) the elastic end portion 58*d* is released from the notch 58*e*, and the stopping member 60 is moved to the shutter plate guide 58*b* side by friction with the felt 61 provided on the back surface of the shutter plate 58*a*. At this moment, the projection 58*c* is engaged with the end wall 60*a*, so that the shutter 58 can force the stopping member 60 to retract from the opening 53.

As shown in FIG. 17(*d*), when the shutter plate 58*a* is completely opened, the stopping member 60 is retracted from the opening 53.

When the shutter plate 58*a* is closed again, as shown in FIG. 17(*e*), as is the case when the shutter plate 58*a* being closed is opened, the stopping member 60 moves into the opening 53 by friction between the felt 61 and the stopping member 60.

FIGS. 9(*a*) through 9(*c*) are cross sections in the vicinity of the toner supply port 50 when the stopping member 60 projects into the opening 53.

As mentioned previously, when the shutter plate 58*a* being opened is closed, the stopping member 60 is moved to the opening 53 side by friction with the shutter plate 58*a* and then is stopped in such a manner so as to be projected into the opening 53. Therefore, the scraper 20 is pressed by the stopping member 60, thereby projecting into the first recessed portion 41. In other words, the stopping member 60 serves to prohibit escaping of the scraper 20 from the first recessed portion 41 when the shutter plate 58*a* is closed.

When the toner container 31 rotates downward with respect to the scraper 20 i.e. in the normal rotation direction, that is, when the toner container 31 rotates in the direction indicated by an arrow R, as shown in FIG. 9(*c*), the scraper 20 being prohibited its rotation by the stopping member 60 slides in contact along the bottom wall 41*b* of the first recessed portion 41. This produces the friction between the scraper 20 and the bottom wall 41*b*, thus restricting the rotation of the toner container 31. The bottom wall 41*b* is provided substantially parallel to the outer circumferential surface of the toner container 31, thus reducing impact caused by sliding of the scraper 20, as compared with the case where the scraper 20 slides in contact along the end wall 41*a*. Therefore, it is possible to effectively stop the rotation of the toner container 31 with a weak impact even when the toner container 31 being rotated is suddenly stopped. This can prevent breakdown of the toner container 31 caused by breakage of the components.

On the other hand, when the toner container 31 moves upward with respect to the scraper 20, i.e. in a direction opposite to the normal rotation direction, that is, when the toner container 31 moves in the direction indicated by an arrow R', as shown in FIG. 9(*b*), the scraper 20 being prohibited its rotation by the stopping member 60 comes into collision with the end wall 41*a* of the first recessed portion 41, thus restricting the rotation of the toner container 31.

As described above, when the shutter plate 58*a* is closed, the scraper 20 restricts the range where the toner container 31 is rotatable. This can prevent a spill of a toner from the toner outlet 43 when the seal 62 sealing the toner outlet 43 of the toner container 31 is unstuck by the rotation of the toner container 31 due to user's operating error. Further, regardless of which direction the toner container 31 rotates in, the scraper 20 being pressed by the stopping member 60 and projected into the first recessed portion 41 can restrict the rotation of the toner container 31. Therefore, even when the toner container 31 moves inside the toner supply device 30 due to vibrations and the like created during transport, the seal 62 is not unstuck, thus preventing a leakage of toner from the toner outlet 43.

Further, a force applied to the stopping member 60 is not more than a predetermined value since the force is created by the friction between the felt 61 bonded on the back surface of the shutter plate 58*a* and the stopping member 60.

Therefore, in the case where the scraper 20 cannot be projected into the toner container 31 side, it is possible to prevent the stopping member 60 from being forced to move into the opening 53. This frees the scraper 20 from projecting to the toner container 31 side by the pressure of the stopping member 60. Therefore, it is possible to prevent breakage of the scraper 20, the stopping member 60, the shutter plate 58*a*, and others.

Here, the case where the scraper 20 cannot be projected into the toner container 31 side is a case where the recessed portion forming portion 35*a* of the toner container 31 does not face the opening 53 of the toner supply port 50, and a case where movement of the scraper 20 to the toner container 31 side is hampered due to coagulation of a toner filled in the toner supply port 50 when the scraper 20 is not projected into the toner container 31 side.

Note that, the friction between the felt 61 and the stopping member 60 may be increased or stabilized by providing the stopping member 60 having a rack gear, an uneven surface created by knurling, or the like on a contact surface which comes into contact with the felt 61.

Here, if the stopping member 60 is pulled out to the toner supply port 50 side when the opening 53 is opened by the shutter plate 58*a*, the scraper 20 cannot be retracted to the opening 51 side by the stopping member 60. At this moment, the toner container 31 cannot rotate, as shown in FIG. 9(*a*), since the scraper 20 is projected into the toner container 31 side (i.e. the scraper 20 is pushed into the first recessed portion 41). If the toner container 31 is now forced to rotate, there could occur a breakdown such as breakage of the scraper 20, the stopping member 60, the shutter plate 58*a*, and a drive section (connecting member and gear) of the toner container 31. To solve such a problem, according to the present invention, the stopping member 60 can be forcibly moved along with opening of the shutter plate 58*a*, and when the shutter plate 58*a* is opened, the scraper 20 can be retracted to the toner supply port 50 side, so that the toner container 31 is rotatable. This can prevent the occurrence of the breakdown.

Further, in the toner supply device 30 having the toner container 31 not in use installed therein, the opening 53 is sealed with the seal 62. This reliably prevents a spill of a toner from the toner outlet 43 of the toner container 31 due to user's operating error and other reasons. When the opening 53 is opened by the shutter plate 58*a*, and the toner container 31 starts rotating, sealing of the opening 53 with the seal 62 is unstuck by a first one rotation, so that toner supply from the opening 53 is possible. At this moment, as described above, other end of the seal 62 is fixed on the scraper 20, so that the seal 62 unstuck from the toner outlet 43 is held by the scraper 20. Therefore, it is possible to prevent the toner container 31 from being hampered its rotation by the seal 62. Therefore, the unstuck seal 62 causes no troubles in the subsequent operations of the toner container 31.

When the shutter plate 58*a* is burst open while sliding, the elastic end portion 58*d* comes into collision with the inner wall of the shutter plate guide 58*b* and stops. At this moment, a force of prying the shutter plate 58*a* is created, and this force causes deformation or the like of the shutter plate 58*a*, whereby the shutter plate 58*a* digs into the shutter plate guide 58*b*. This could produce a breakdown such as failure of closing the shutter plate 58*a*. To solve such a problem, according to the present invention, the elastic end portion 58*d* has a U-shape cross section, thereby reducing impact caused when the shutter plate guide 58*b* comes into collision with the elastic end portion 58*d*. This can prevent breakdown of the shutter 58.

Further, by fitting the elastic end portion 58*d* in the notch 58*e* provided on the shutter plate guide 58*b*, it is also possible to add the function of stopping the shutter plate 58*a* at closed position.

Note that, in the present embodiment, the present embodiment has described that the elastic end portion 58*d* has a U-shape cross section. However, the present invention is not limited to this. The elastic end portion 58*d* may has an arc shape cross section, or a cross section with a shape such that the elastic end portion 58*d* can fit the notch 58*e* and impact caused by collision with the shutter plate guide 58*b* and the closing pawl 104 can be reduced.

Also, the shape of the stopping member 60, not limited to one that has been described in the present embodiment, may be any shape, provided that the stopping member 60 can move by interlocking with the shutter plate 58*a* being opened or closed, and moves into the toner supply port 50 when the shutter plate 58*a* is closed, and thereby pushes the scraper 20 into a recessed portion 41. The stopping member 60 is preferably made of material having elasticity and impact resistance, such as polyacetal resin (POM), or acrylonitrile-butadiene-styrene resin (ABS). In addition, the stopping member 60 is preferably made of material that is the same as material of which other members making up the shutter 58 is made, in view of designing.

Further, the printer 100 of the present invention includes the stopper 58*g*, so that with the shutter plate 58*a* closed the stopper 58*g* can stop the locking pawl 58*f* provided on the shutter plate 58*a*. This can prevent the shutter plate 58*a* from being opened accidentally. That is, it is possible to prevent the user and the toner container 31 from becoming dirty with a toner spilled out from the opening 51 when the user accidentally opens the shutter plate 58*a* after the seal 62 is unstuck.

As described above, the toner supply device 30 having been inserted into the printer 100 is jointed to the printer 100 at the first container portion 33. FIG. 12 illustrates a state where the toner supply device 30 is jointed to the main-body joint 80 of the printer 100 and illustrates a top view of the toner hopper 8. The main-body joint 80 has a joint receiving section 81 which rotates by a drive force from a drive source 85 such as a motor of the printer 100. The joint receiving portion 81 is jointed to the toner container 31 of the toner supply device 30. More specifically, the joint is realized by fitting, in recessed receiving portions 82 provided to the joint receiving portion 81, the raised portions 37 and the lid 46 both of which are provided on the bottom portion 33*a* of the first container portion 33 in the toner container 31.

The joint receiving portion 81, as shown in FIG. 12, is attached to a rotation axis 84 which penetrates a cabinet 88 of the printer 100 such that it is aligned with a center of rotation of the rotation axis 84. To the rotation axis 84 between the cabinet 88 and the joint receiving portion 81, a spring member 83 such as a compression coil spring is attached. The spring member 83 is pulled in a direction in which the joint receiving portion 81 steps away from the cabinet 88. Therefore, movement of the toner supply device 30 in a direction of installation is restricted by a restricting member (not shown) in such a manner that the toner supply device 30 presses the joint receiving portion 81.

As described above, in the toner supply device 30 installed in the printer 100, a drive force from the drive source 85 of the printer 100 is transferred to the joint receiving portion 81 via a speed reducer 86, such as a gear, and the rotation axis 84, and the rotation of the joint receiving portion 81 rotates the toner container 31 about the center of the cylinder axis of the toner container 31.

Figure 13:
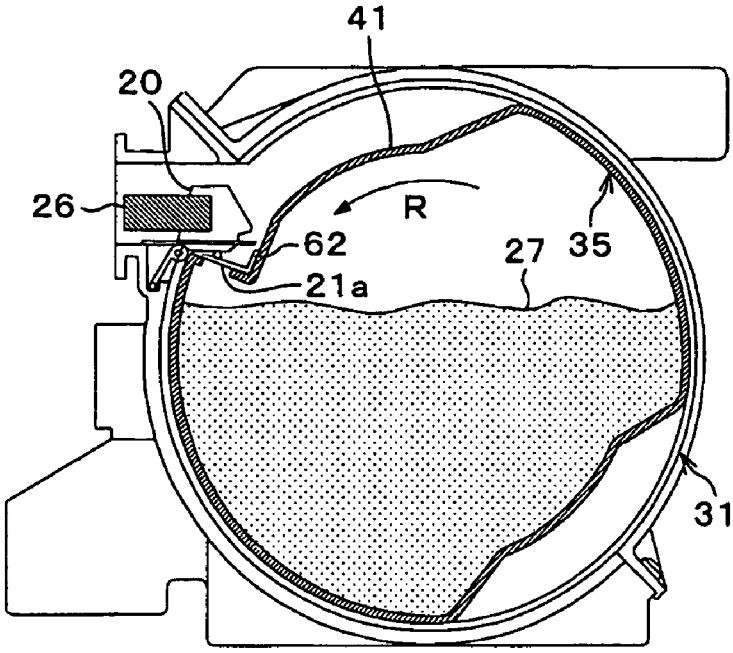
FIG. 13(*a*) illustrates the operation when toner is supplied from the toner supply device shown in FIG. 1(*a*), and is a cross sectional view showing a state where a toner outlet is sealed with a seal.
Figure 13:
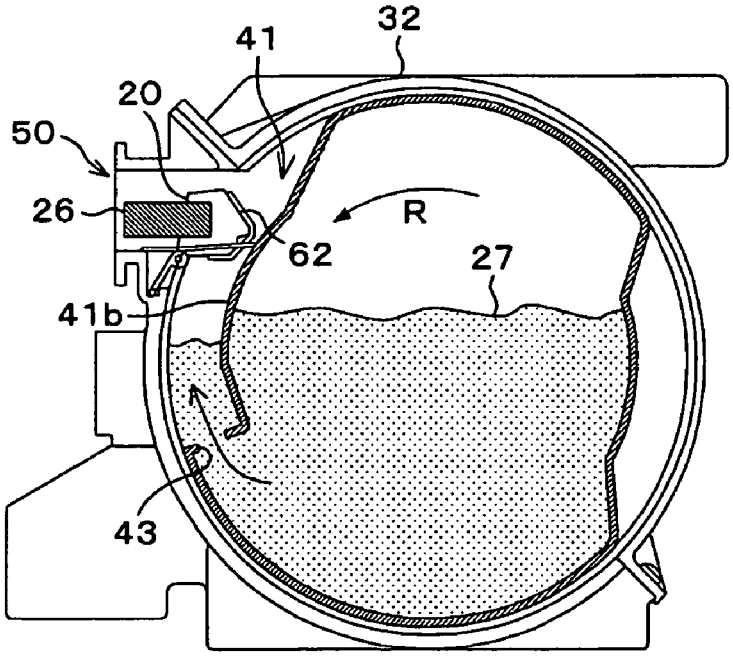
Figure 14:
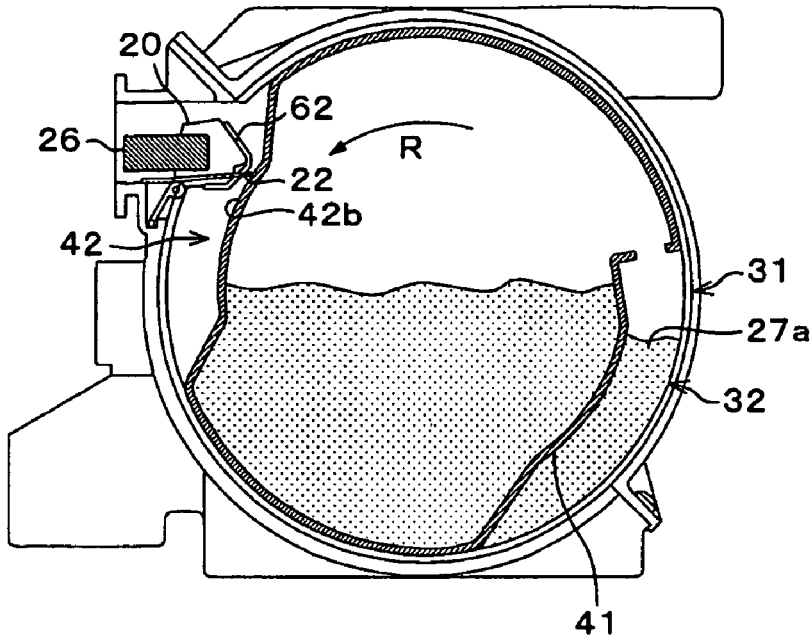
FIG. 14(*a*) illustrates the operation when toner is supplied from the toner supply device shown in FIG. 1(*a*), and is a cross sectional view showing a state where the toner ejecting sheet is placed in a second recessed portion.
Figure 14:
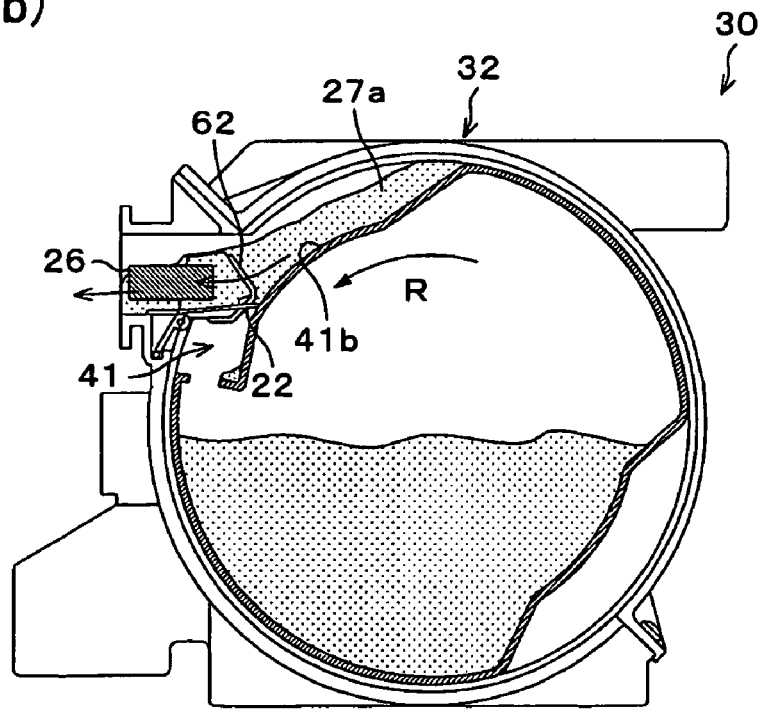

Next, the following will describe in detail the operation of the above-arranged toner supply device 30 in the printer 100 with reference to the drawings referred for the above descriptions and FIGS. 13(*a*) and 13(*b*) and FIGS. 14(*c*) and 14(*d*).

In the above-described toner supply device 30, as shown in FIG. 6, with the toner container 31 supported by the support member 32, spaces are formed respectively between the first recessed portion 41 of the recessed portion forming portion 35*a* of the third container portion 35 and the support member 32 and between the second recessed portion 42 of the recessed portion forming portion 35*a* of the third container portion 35 and the support member 32. In this state, in the printer 100, when the toner container 30 rotates about the cylinder axis under the drive force from the drive source 85 illustrated in FIG. 12, a toner placed at the first container portion 33 and the second container portion 34 of the toner container 30 (FIG. 4) is transported along the transport portions 36 and 39. At this moment, the transported toner is collected in the third container portion 35.

The toner collected in the third container portion 35 is ejected from the toner outlet 43 provided in the first recessed portion 41 illustrated in FIG. 5 into the first recessed portion 41. More specifically, as shown in FIG. 13(*a*), in a state where the first recessed portion 41 and the scraper 20 face each other, and the end of the toner ejecting sheet 22 of the scraper 20 is not in contact with the bottom wall 41*b* of the first recessed portion 41, the sheet hold portion 21*a* of the base portion 21 is held toward the third container portion 35. In the state illustrated in FIG. 13(*a*), when the toner container 31 containing the toner 27 rotates about the cylinder axis in the rotational direction R, as shown in FIG. 13(*b*), one end of the seal 62 having sealed the toner outlet 43 of the first recessed portion 41 is unstuck, allowing toner to be ejected from the toner outlet 43. Then, the end of the toner ejecting sheet 22 of the scraper 20 is brought into contact with the bottom wall 41*b* of the first recessed portion 41. As mentioned above, the other end of the unstuck seal 62 is kept fixed on the scraper 20. This can reliably prevent the seal 62 unstuck after opening of the sealed toner container 31 from jamming into a space of a rotation area of the toner container 31 and locking the toner container 31. That is, this can prevent the rotation of the toner container 31 from being hampered by the seal 62.

As mentioned above, the first recessed portion 41 has the toner outlet 43, provided downstream in the rotational direction R of the toner container 31, communicating between the inside and outside of the toner container 31. Therefore, as shown in FIG. 13(*b*), when the toner outlet 43 is brought into contact with the surface of the toner 27 in the toner container 31 by the rotation of the toner container 31, the toner is flown from the toner outlet 43 into a space between the first recessed portion 41 and the support member 32 with the rotation of the toner container 31.

With the rotation of the toner container 31, when the entire first recessed portion 41 passes by the toner supply port 50 having the scraper 20 provided therein, as shown in FIG. 8(*b*), the end of the toner ejecting sheet 22 and the end of the sheet hold portion 21*a* are brought into contact with the outer circumferential surface of the recessed portion forming portion 35*a* between the first recessed portion 41 and the second recessed portion 42. At this moment, with the toner 27 held between the first recessed portion 41 and the support member 32, the toner container 31 rotates.

When the toner container 31 further rotates, as shown in FIG. 14(*a*), the second recessed portion 42 and the scraper 20 face each other, and the end of the toner ejecting sheet 22 of the scraper 20 slides along the bottom wall 42*b* of the second recessed portion 42. The second recessed portion 42 does not have an opening that communicates between the inside and the outside of the toner container 31, so that the toner 27 contained in the toner container 31 does not flow into a space between the second recessed portion 42 and the support member 32. In this case, with the toner 27*a* held in the space between the first recessed portion 41 and the support member 32, the toner container 31 rotates.

Thereafter, with the toner 27*a* held in the space between the first recessed portion 41 and the support member 32 and transported, the first recessed portion 41 faces the scraper 20 again. Then, when the end of the toner ejecting sheet 22 of the scraper 20 is brought into contact with the bottom wall 41*b* of the first recessed portion 41, as shown in FIG. 14(*b*), the toner 27*a* in the space between the first recessed portion 41 and the support member 32 is scooped up by the end of the toner ejecting sheet 22. At this moment, the bottom wall 41*b* of the first recessed portion 41 is slightly tilted substantially parallel to the outer circumferential surface of the toner container 31. This allows the toner 27*a* to be smoothly transported from the first recessed portion 41 side into the toner supply port 50, pass over the toner ejecting sheet 22.

The scraper 20 is provided with the walls 23*a* and 23*b* (FIG. 10(*a*)), so that the transported toner can be transported smoothly from the toner supply port 50 to the toner hopper 8. That is, provision of the walls 23*a* and 23*b* can prevent toner from flowing in a direction perpendicular to the transport direction of toner from the toner supply device 30 into the toner hopper 8, and can smoothly transport toner along the toner transport direction that is a direction from the toner supply device 30 side to the toner hopper 8 (FIG. 3).

Figure 15:
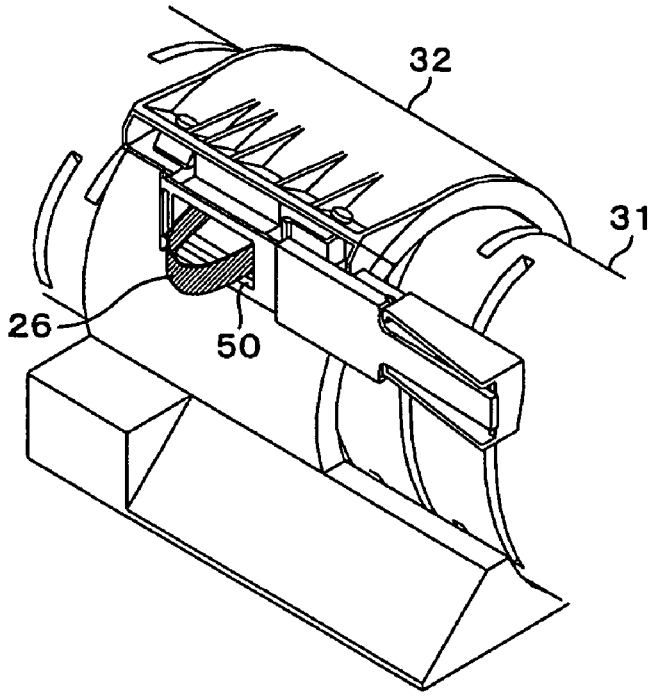
FIG. 15 is a perspective view showing a blocking preventing member included in the toner supply device shown in FIG. 1(*a*).

Further, the blocking preventing member 26 fixed to the walls 23*a* and 23*b* moves in parallel to the transport direction of toner above the toner transport path 52 by interlocking with the movement of the scraper 20 sliding along the recessed portion forming portion 35*a* (FIGS. 8(*a*) and 8(*b*)). Therefore, as shown in FIG. 8(*b*), when the end of the toner ejecting sheet 22 provided to the scraper 20 is brought into contact with the outer circumferential surface of the recessed portion forming portion 35*a* between the first recessed portion 41 and the second recessed portion 42, as shown in FIG. 15, the end of the blocking preventing member 26 sticks out the toner supply port 50. That is, the end of the blocking preventing member 26 is pushed out the opening 53 of the toner supply port 50 toward the toner hopper 8 side. This ensures the toner on the toner transport path 52 of the toner supply port 50 to be transported to the toner hopper 8 side, and thus ensures toner flow in the vicinity of the opening 53 and supply of the toner ejected from the toner container 31 to the toner hopper 8.

Figure 16:
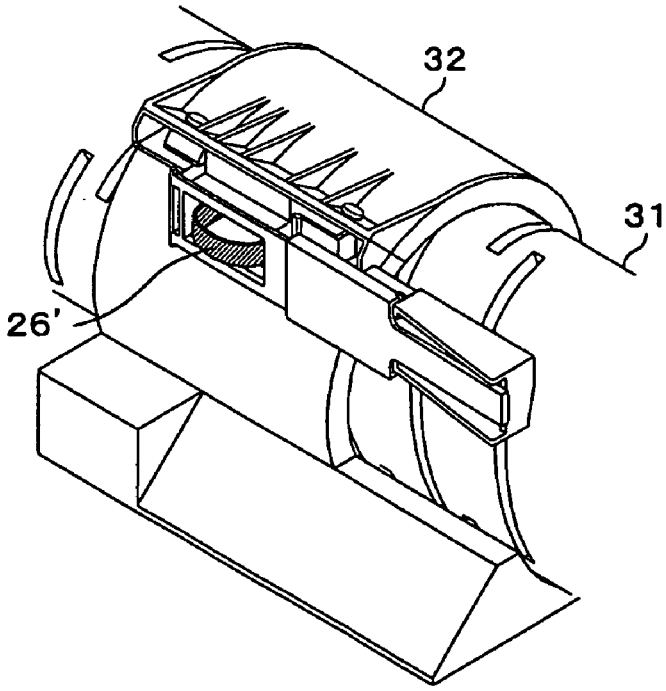
FIG. 16 is a perspective view showing another example of the blocking preventing member shown in FIG. 15.

Note that, the present embodiment is arranged such that the end of blocking preventing member 26 is pushed out the toner supply port 50 from the opening 53 and is stuck out toward the toner hopper 8 side. However, the present invention is not limited to this arrangement. That is, in order to ensure toner flow in the vicinity of the opening 53, as shown in FIG. 16, it can be arranged such that the end of a blocking preventing member 26' moves to the opening 53. This arrangement also ensures toner flow in the opening 53 and transport of the toner in vicinity of the opening 53 into the toner hopper 8 side.

Further, the above description has explained that the toner is not held in the space between the second recessed portion 42 and the support member 32. In this space, a part of the toner 27*a* flown into the space between the first recessed portion 41 and the support member 32 might be held. That is, with the rotation of the toner container 31, there might occur a leakage of part of the toner 27*a* flown into the space between the first recessed portion 41 and the support member 32, to the guide flap forming portions 35*b* and 35*c* (FIG. 5) side provided to the third recessed portion of the toner container 31. In such a case, the ejection guide flaps 44*b* and 44*c* respectively provided on the guide flap forming portions 35*b* and 35*c* transport and collect the toner on the guide flap forming portions 35*b* and 35*c* to the first recessed portion 41 and the second recessed portion 42. Therefore, in the space between the first recessed portion 41 and the support member 32 (hereinafter referred to as "first space") and in the space between the second recessed portion 42 and the support member 32 (hereinafter referred to as "second space"), the toner leaked on the guide flap forming portions 35*b* and 35*c* may be held.

Thus, out of the toner leaked on the guide flap forming portions 35*b* and 35*c*, the toner collected in the first space, as has been described with reference to FIGS. 13(*a*) and 13(*b*) and FIGS. 14(*a*) and 14(*b*), is transported to the toner supply port 50, with the toner ejected from the toner outlet 43 of the first recessed portion 41. On the other hand, out of the toner leaked on the guide flap forming portions 35*b* and 35*c*, the toner transported to the second space, as shown in FIG. 14(*a*), is scooped up by the end of the toner ejecting sheet 22 by sliding of the scraper 20 along the bottom wall 42*b* of the second recessed portion 42. The scooped toner is transported from the second recessed portion 42 side to the toner supply port 50, passing on the toner ejecting sheet 22. This enables the toner leaked on the guide flap forming portions 35*b* and 35*c* to be supplied for use in development into the toner hopper 8, without being wasted.

As described above, by the rotation of the toner container 31, toner can be flown into the first recessed portion 41 and be transported to the toner supply port 50. Therefore, even when the amount of remaining toner in the toner container 31 is low, the toner placed on the bottom of the toner container 31 with respect to the gravitational direction can be flown into the first space. Therefore, without great dependence upon the amount of remaining toner in the toner container 31, toner can be flown into the first space, so that the toner transported by the first recessed portion 41 can be transported through the toner supply port 50 into the toner hopper 8 side in a preferred manner.

As shown in FIG. 3, the toner supply port 50 is provided in the printer 100 such that it is above the cylinder axis L of the toner container 31. This allows the toner held in the first space to be smoothly dropped in the toner supply port 50 along the bottom wall 41*b* of the first recessed portion 41 provided in the cylindrical toner container 31. This enables a preferred supply of toner from the toner supply device 30 to the toner hopper 8.

Further, as to the toner in the space between the first recessed portion 41 and the support member 32 and the space between the second recessed portion 42 and the support member 32, the end of the toner ejecting sheet 22 included in the scraper 20 slides along the bottom wall 41*b* of the first recessed portion 41 and the bottom wall 42*b* of the second recessed portion, respectively, thereby scooping up the toner from the first recessed portion 41 and the second recessed portion 42 and scraping it to the toner supply port 50 side. This ensures the toner collected in the first space and the second space to be scooped up and scraped, so that the toner can be transported from the first recessed portion 41 and the second recessed portion 42 in the toner container 31 onto the toner transport path 52 of the toner supply port 50.

Still further, the scraper 20 is provided with the blocking preventing member 26. Therefore, the toner transported into the toner supply port 50 by the scraper 20 can be further transported into the toner hopper 8 side by the blocking preventing member 26. This ensures toner flow in the opening 53 of the toner supply port 50 and a smooth transport of the toner from the toner supply device 30 to the toner hopper 8.

According to the present invention, thanks to provision of the stopping member 60 that moves in the toner supply port 50 when the shutter plate 58*a* become closed, the scraper 20 can serve to scrape toner and to restrict the rotation of the tone container 31. Therefore, with a simple arrangement, it is possible to realize stabilization in amount supplied of the toner ejected out of the toner container 31 and prevention of a toner spill caused by user's operating error.

The toner having been transported into the toner hopper 8 in the manner as described above, as shown in FIG. 12, is first agitated in the toner hopper 8 by an agitating member 11. The agitating member 11 includes an agitation axis 11*a* having impellers 11*b* provided thereto. By rotation of the agitation axis 11*a*, the impellers 11*b* rotate about the agitation axis 11*a*, which agitates toner inside the toner hopper 8. Then, the toner having been agitated by the agitating member 11 is transported to a supply roller 12 side by the agitation of the agitating member 11. The supply roller 12 supplies the toner having transported by the agitating member 11 to the developing device 4.

According to the above operation, toner is ejected from the toner supply device 30, and when the amount of remaining toner in the toner container 31 becomes low, the toner supply device 30 is detached from the printer 100 so that toner can be supplied from the toner supply opening 45 (FIG. 4) of the toner container 31.

For detachment of the toner supply device 30 from the printer 100, the above-mentioned restriction of the restricting member to the toner supply device 30 is released. Then, the toner supply device 30 is moved in a direction opposite to the direction in which the toner supply device 30 is inserted into the printer 100, and the toner supply device 30 is detached from the printer 100 according to guidance of the rib 57*a* and the mount guide portions 57*b* and 57*c* provided on the support member 32 (FIG. 6).

At this moment, the shutter displacing member provided in the printer 100, as shown in FIGS. 11(*a*) and 11(*b*), causes the shutter plate 58*a* of the shutter 58 provided on the support member 32 of the toner supply device 30 to slide. When the toner supply device 30 is installed in the printer 100, the shutter 58 is opened. When the toner supply device 30 is detached from the printer 100, the shutter displacing member allows the shutter plate 58*a* to slide such that the opened shutter 58 becomes closed. That is, as shown in FIG. 11(*b*), the shutter plate 58*a* slides such that it covers the opening 53 of the toner supply port 50.

When the shutter plate 58*a* slides so that the shutter 58 closes the toner supply port 50, toner may spill out in an area between the opening 53 and the toner opening (not shown) of the toner hopper 8 due to built-up toner in the vicinity of the opening 53 of the toner supply port 50. However, the toner supply port 50 is provided with the blocking preventing member 26. As described earlier, the blocking preventing member 26 pushes out toner to the toner hopper 8 side, thereby ensuring toner flow in the vicinity of the opening 53. Therefore, even when the shutter 58 operates to close the toner supply port 50, no toner spills out from the opening 53. Accordingly, it is possible to prevent the flying of toner spilt out from the opening 53 in the printer 100.

Note that, in the present embodiment, as shown in FIG. 10(*a*), the blocking preventing member 26 (FIG. 1) having an arc shape with its both ends respectively fixed to the walls 23*a* and 23*b* is used. However, the shape of the blocking preventing member is not limited to this. That is, for example, with a T-shaped or L-shaped blocking preventing member having elasticity provided respectively to the walls 23*a* and 23*b* can also push out, toward the opening 53, toner built up on the toner transport path 52 of the toner supply port 50.

Further, in the present embodiment, the blocking preventing member 26 is provided to the scraper 20. However, it may be provided inside the toner supply port 50, for example. Also, in this case, it is preferable that the blocking preventing member can push out toner built up on the toner transport path 52 in accordance with movement of the end of the toner ejecting sheet 22 of the scraper 20 placed on the toner transport path 52. That is, for example, the blocking preventing member should be provided in a door manner such that it opens or closes by being pushed by the end of the toner ejecting sheet 22 inside the toner supply port 50. This allows the blocking preventing member to open in the direction of the opening 53 by interlocking with movement of the scraper 20 when the scraper 20 slides along the recessed portion forming portion 35*a* of the toner container 31, thus pushing out toner built up on the toner transport path 52.

A developer supply device of the present invention is detachably provided for use in a developing device incorporated in an electrophotographic image forming apparatus such as printer, copier, and facsimile machine. In a developer supply device of the present invention, a stopping member which restricts the rotation of the developer container when the developer supply port is closed is provided, so that it is possible to prevent developer from spilling out from an outlet when the developer supply device is rotated by user's operating error.

As described above, a developer supply device of the present invention is arranged such that the scraping member is provided so as to slide in contact along the recessed portion when the developer supply port is closed by the plate part.

According to the above arrangement, friction produced when the scraping member slides in contact along the developer supply device can restrict the rotation of the developer supply device.

Further, the rotation of the developer container on the axis line as a rotation axis causes the scraping member to slide in contact along the recessed portion in the recessed portion forming region of the developer container, so that almost all the developer ejected in the recessed portion can be scraped. Therefore, without depending upon the amount of developer filled in the developer container, it is possible to stabilize the amount supplied of the developer ejected out of the developer supply device. Therefore, the scraping member can serve to restrict the rotation of the developer container and to scrape developer. This realizes, with this arrangement, stabilization in amount supplied of the developer ejected out of the developer container and prevention of a developer spill caused by user's operating error.

Further, a developer supply device of the present invention is arranged such that the recessed portion has a bottom wall formed substantially parallel to the outer circumferential surface of the developer container, and the scraping member is provided so as to slide in contact along the bottom wall.

According to the above arrangement, friction produced when the scraping member slides in contact along the bottom wall can restrict the rotation of the developer supply device. Therefore, it is possible to prevent a leakage of toner from the outlet even when the developer container moves inside the developer supply device due to vibrations and the like created during transport. Further, the bottom wall is provided substantially parallel to the outer circumferential surface of the developer supply device, thus reducing impact caused by contact of the scraping member, as compared with the case where the scraping member comes into contact with the end wall and others around the outlet. Therefore, it is possible to effectively stop the rotation of the developer supply device with a weak impact even when the developer container being rotated is suddenly stopped. This can prevent breakdown of the developer supply device caused by breakage of the components.

Further, in order to solve the above problem, a developer supply device of the present invention is arranged, such that the developer container further includes a seal for sealing the outlet, and the seal is unstuck by the rotation of the developer container.

According to the above arrangement, thanks to the seal, it is possible to reliably prevent toner from spilling out from the outlet.

Still further, a developer supply device of the present invention is arranged such that the seal has one end bonded with the outlet so as to seal the outlet, and has the other end fixed to the scraping member.

According to the above arrangement, it is possible to prevent a toner spill from the outlet of the developer container caused by user's operating error and other reasons. Further, according to the above arrangement, when the developer container becomes rotatable, the seal unstuck from the outlet is held by the scraping member. During the rotation of the developer container, this can reliably prevent the seal from jamming into a space of a rotation area of the developer container and locking the rotation of the developer container. That is, this can prevent the rotation of the developer container from being hampered by the seal.

Yet further, a developer supply device of the present invention is arranged such that the shutter further includes a plate guide for allowing the plate part to slide, and the plate part on its back surface has a sliding member for sliding in contact along the stopping member.

According to the above arrangement, thanks to friction produced between the sliding member and the stopping member by interlocking closing of the developer supply port by the plate part, it is possible to move the stopping member into the developer supply port. This can make a force applied to the stopping member to be not more than a predetermined value. Therefore, in the case where the scraping member cannot be projected into the developer container side, it is possible to prevent the stopping member from being forced to move into the developer supply port. This frees the scraping member from projecting to the developer container side by the pressure of the stopping member. Therefore, it is possible to prevent breakage of the scraping member, the stopping member, the plate part, and others.

Here, the case where the scraping member cannot be projected into the developer container side is a case where the recessed portion forming region of the developer container does not face the developer supply port, and a case where movement of the scraping member to the developer supply device is hampered due to coagulation of a toner filled in the developer supply port when the scraping member is not projected into the developer supply device side.

Further, a developer supply device of the present invention is arranged such that the plate part includes an elastic end portion formed of an elastic member with a U-shape in cross section in a direction of movement of the plate part, and the plate guide has a recessed portion which can fit the elastic end portion when the plate part is closed.

According to the above arrangement, when a force is applied to the elastic end portion being fit in the recessed portion, the elastic end portion undergoes elastic deformation. This frees from unmoving of the plate part caused when the elastic end portion gets snagged in the recessed portion. Further, during detachment of the developer supply device from the image forming apparatus, it is possible to reduce impact caused when the elastic end portion comes into collision with the closing pawl fixed to the hopper of the image forming apparatus. Therefore, it is possible to smoothly detach the developer supply device from the image forming apparatus, and to prevent breakdown of the shutter and components of the image forming apparatus due to impact caused by collision.

Further, a developer supply device of the present invention is such that the plate part on its back surface has a projection, and the stopping member has a projection which projects on the plate part side and engages with the projection of the plate part with opening movement of the plate part, the projection of the stopping member being formed on a surface of the stopping member facing the plate part, at one end of the stopping member in an opening direction of the plate part.

According to the above arrangement, when the plate part is opened, the projection of the plate part engage with the projection of the stopping member, so that the plate part can force the stopping member to retract from the developer supply port of the developer container side to the outside of the developer supply port by interlocking with opening movement of the plate part. This ensures the developer supply device to be rotatable when the plate part is opened.

Further, in the case where the stopping member is projected into the developer supply port when the plate part is opened, the scraping member is also projected to the developer supply device side by the stopping member. At this moment, if the developer supply device is forced to rotate, there could occur breakage of the scraping member, the stopping member, the plate part, and other components. According to the above arrangement, the stopping member can be forcibly moved along with opening of the plate part, so that it is possible to prevent the stopping member from projecting into the developer supply port during rotation of the developer supply device. This can prevent a breakdown of the developer supply device caused by breakage of the scraping member, the stopping member, the plate part, and other components.

Still further, a developer supply device of the present invention is arranged such that the plate guide includes a stopper for stopping the plate part when the developer supply port is closed by the plate part.

According to the above arrangement, the stopper provided on the plate guide can stop the plate part, so that it is possible to prevent the plate part from accidentally being opened due to user's operating error and other reasons.

In order to solve the above problem, an image forming apparatus of the present invention is arranged such that the developer supply device is detachably installed therein.

According to the above arrangement, the developer supply device installed in the image forming apparatus can restrict the rotation of the developer container, so that it is possible to prevent developer from spilling out of the developer supply port due to the rotation of the developer container caused by user's operating error during handling of the developer container.

Further, an image forming apparatus of the present invention is preferably such that in the foregoing image forming apparatus, the developer supply device is installed such that the developer supply port is provided above the axis line of the developer container.

According to the above arrangement, utilizing a natural drop of the developer in the recessed portion of the developer container, caused by the rotation of the developer container, the developer is scraped by the scraping member and is transported into the developer supply port.

Specific embodiments or examples implemented in the description of the embodiments only show technical features of the present invention and are not intended to limit the scope of the invention. Variations can be effected within the spirit of the present invention and the scope of the following claims.

What is claimed is:

1. A developer supply device which supplies developer to an outside of the developer supply device by rotating a cylindrical developer container containing the developer on an axis line of the developer container as a rotation axis, wherein:

the developer container has an outlet in a recessed portion provided on an outer circumferential surface of the developer container, the developer supply device includes:

a support member, by surrounding at least a recessed portion forming region formed around the outer circumferential surface along a direction of rotation of the developer container so as to include the recessed portion, rotatably holding the developer container, and having a developer supply port for supplying, to the outside of the developer supply device, the developer ejected from the outlet into the recessed portion; and a scraping member, provided in the developer supply port so as to slide along the recessed portion forming region during rotation of the developer container, scraping the developer in the recessed portion by sliding along the recessed portion in the recessed portion forming region;

the support member being provided with a shutter including a movable plate part for opening and closing the developer supply port, the shutter having a stopping member moving into the developer supply port by interlocking with movement of the plate part closing the developer supply port, and thereby pushing the scraping member into the recessed portion and restricting the rotation of the developer container.

2. The developer supply device according to claim 1, wherein:

the scraping member is provided so as to slide in contact along the recessed portion when the developer supply port is closed by the plate part.

3. The developer supply device according to claim 2, wherein:

the recessed portion has a bottom wall formed substantially parallel to the outer circumferential surface of the developer container, and the scraping member is provided so as to slide in contact along the bottom wall.

4. The developer supply device according to claim 1, wherein:

the developer container further includes a seal for sealing the outlet, and the seal is unstuck by the rotation of the developer container.

5. The developer supply device according to claim 4, wherein:

the seal has one end bonded with the outlet so as to seal the outlet, and has the other end fixed to the scraping member.

6. The developer supply device according to claim 1, wherein:

the shutter further includes a plate guide for allowing the plate part to slide, and the plate part on its back surface has a sliding member for sliding in contact along the stopping member.

7. The developer supply device according to claim 6, wherein:

the plate part includes an elastic end portion formed of an elastic member with a U-shape in cross section in a direction of movement of the plate part, and the plate guide has a recessed portion which can fit the elastic end portion when the plate part is closed.

8. The developer supply device according to claim 6, wherein:

the plate part on its back surface has a projection, and the stopping member has a projection which projects on the plate part side and engages with the projection of the plate part with opening movement of the plate part, the projection of the stopping member being formed on a surface of the stopping member facing the plate part, at one end of the stopping member in an opening direction of the plate part.

9. The developer supply device according to claim 6, wherein:

the plate guide includes a stopper for stopping the plate part when the developer supply port is closed by the plate part.

10. An image forming apparatus having installed therein a developer supply device which supplies developer to an outside of the developer supply device by rotating a cylindrical developer container containing the developer on an axis line of the developer container, as a rotation axis, wherein:

the developer container has an outlet in a recessed portion provided on an outer circumferential surface of the developer container, the developer supply device includes:

a support member, by surrounding at least a recessed portion forming region formed around the outer circumferential surface along a direction of rotation of the developer container so as to include an area where the recessed portion is provided, rotatably holding the developer container, and having a developer supply port for supplying, to the outside of the developer supply device, the developer ejected from the outlet into the recessed portion; and a scraping member, provided in the developer supply port so as to slide along the recessed portion forming region during rotation of the developer container, scraping the developer in the recessed portion by sliding along the recessed portion in the recessed portion forming region;

the support member being provided with a shutter including a movable plate part for opening and closing the developer supply port, the shutter having a stopping member moving into the developer supply port by interlocking with movement of the plate part closing the developer supply port, and thereby pushing the scraping member into the recessed portion and restricting rotation of the developer container.

11. The image forming apparatus according to claim 10, wherein:

the developer supply device is installed in such a manner that the developer supply port is provided such that it is above the axis line of the developer container.

12. A developer supply device comprising:

(a) a developer container having a cylinder capable of containing developer therein, having an outlet in a recessed portion provided on an outer circumferential surface of the cylinder, and ejecting the developer from the outlet into the recessed portion by rotation of the cylinder on an axis line of the cylinder as a rotation axis;

(b) a support member covering an area, including the recessed portion, in a circumferential direction of the developer container such that the developer container is rotatable, and having a developer supply port for supplying, to outside of the developer supply device, the developer ejected into the recessed portion;

(c) a shutter, provided to the developer supply port, opening and closing the developer supply port; and (d) a rotation restricting member restricting rotation of the developer container when the developer supply device is not installed into a target apparatus for installation, and releasing the restriction when the developer supply device is installed into a target apparatus for installation, wherein the rotation restricting member controls the rotation by interlocking with closing of the shutter with respect to the developer supply port, and the rotation restricting member releases the restriction by interlocking with opening of the shutter with respect to the developer supply port.

13. The developer supply device according to claim 12, further comprising:

a scraping member, provided so as to move into the recessed portion and move out of the recessed portion, scraping the developer in the recessed portion, wherein the rotation restricting member has a stopping member pushing the scraping member into the recessed portion by interlocking with the shutter being closed, thereby restricting the rotation of the developer container.

14. The developer supply device according to claim 13, wherein:

when being pushed into the recessed portion by interlocking with the shutter being closed, the scraper member slides in contact along the recessed portion.

15. The developer supply device according to claim 14, wherein:

the recessed portion has a bottom wall formed substantially parallel to the outer circumferential surface of the developer container, and the scraping member is provided so as to slide in contact along the bottom wall.

16. The developer supply device according to claim 12, wherein:

the developer container further includes a seal for sealing the outlet, and the seal is unstuck by the rotation of the developer container.

17. The developer supply device according to claim 16, wherein:

the seal has one end bonded with the outlet so as to seal the outlet, and has the other end fixed to the scraping member.

18. The developer supply device according to claim 12, wherein:

the shutter includes: a plate part opening and closing the developer supply port; and a plate guide for allowing the plate part to slide in the open and close direction, and the plate part on its back surface has a sliding member for sliding in contact along the stopping member.

19. The developer supply device according to claim 18, wherein:

the plate part includes an elastic end portion formed of an elastic member with a U-shape in cross section in a direction of movement of the plate part, and the plate guide has a recessed portion which can fit the elastic end portion when the plate part is closed.

20. The developer supply device according to claim 18, wherein:

the plate part on its back surface has a projection, and the stopping member has a projection which projects on the plate part side and engages with the projection of the plate part with opening movement of the plate part, the projection of the stopping member being formed on a surface of the stopping member facing the plate part, at one end of the stopping member in an opening direction of the plate part.

21. The developer supply device according to claim 18, wherein:

the plate guide includes a stopper for stopping the plate part when the developer supply port is closed by the plate part.

22. The developer supply device according to claim 12, wherein:

the support member rotatably supports the developer container.

23. An image forming apparatus having detachably installed therein a developer supply device comprising:

(a) a developer container having a cylinder capable of containing developer therein, having an outlet in a recessed portion provided on an outer circumferential surface of the cylinder, and ejecting the developer from the outlet into the recessed portion by rotation of the cylinder on an axis line of the cylinder as a rotation axis;

(b) a support member covering an area, including the recessed portion, in a circumferential direction of the developer container such that the developer container is rotatable, and having a developer supply port for supplying, to outside of the developer supply device, the developer ejected into the recessed portion;

(c) a shutter, provided to the developer supply port, opening and closing the developer supply port; and (d) a rotation restricting member restricting rotation of the developer container when the developer supply device is not installed into a target apparatus for installation, and releasing the restriction when the developer supply device is installed into a target apparatus for installation, wherein the rotation restricting member controls the rotation by interlocking with closing of the shutter with respect to the developer supply port, and the rotation restricting member releases the restriction by interlocking with opening of the shutter with respect to the developer supply port.

24. The image forming apparatus according to claim 23, wherein:

the developer supply device is installed such that the developer supply port is provided above the axis line of the developer container.

* * * * *